US010658784B2

(12) United States Patent
Sato

(10) Patent No.: US 10,658,784 B2
(45) Date of Patent: May 19, 2020

(54) CRIMP TERMINAL

(71) Applicant: Yazaki Corporation, Tokyo (JP)

(72) Inventor: Kei Sato, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/423,845

(22) Filed: May 28, 2019

(65) Prior Publication Data

US 2019/0280422 A1 Sep. 12, 2019

Related U.S. Application Data

(63) Continuation-in-part of application No. PCT/JP2017/016502, filed on Apr. 26, 2017.

(30) Foreign Application Priority Data

Dec. 27, 2016 (JP) ..... 2016-253776

(51) Int. Cl.
*H01R 13/52* (2006.01)
*H01R 4/20* (2006.01)
(Continued)

(52) U.S. Cl.
CPC ..... *H01R 13/52* (2013.01); *H01R 4/184* (2013.01); *H01R 4/20* (2013.01); *H01R 4/62* (2013.01);
(Continued)

(58) Field of Classification Search
CPC .... H01R 13/52; H01R 13/5216; H01R 4/184; H01R 4/20; H01R 4/62; H01R 43/005; H01R 43/048
See application file for complete search history.

(56) References Cited

U.S. PATENT DOCUMENTS 6,514,102 B1 2/2003 Murakami et al.
8,974,258 B2 3/2015 Mitose et al.
(Continued)

FOREIGN PATENT DOCUMENTS

CN 102859795 A 1/2013
JP 3566541 B2 9/2004
(Continued)

OTHER PUBLICATIONS

International Search Report for PCT/JP2017/016502 dated Jul. 18, 2017 [PCT/ISA/210.

*Primary Examiner* — Oscar C Jimenez
(74) *Attorney, Agent, or Firm* — Sughrue Mion, PLLC

(57) ABSTRACT

Difficulty of manufacturing is reduced while providing waterproof property with respect to a contact portion with an aluminum core wire. A barrel portion of a crimp terminal includes an inner barrel piece and an outer barrel piece, and an inner surface is provided with a plurality of recesses arranged dispersedly, and a groove extending in in a first region at the outer barrel piece, a second region at a location close to a terminal portion and a third region on an opposite side. A second portion of a seal member formed from adhesive gel is formed into a strip-like shape having width that allows a part thereof to be pushed out after crimping, and a first seal portion is formed into a shape corresponding to the groove and having narrower width than the second seal portion.

4 Claims, 25 Drawing Sheets

(51) Int. Cl.

| | |
|---|---|
| ***H01R 43/00*** | (2006.01) |
| ***H01R 43/048*** | (2006.01) |
| ***H01R 4/18*** | (2006.01) |
| ***H01R 4/62*** | (2006.01) |

(52) U.S. Cl.
CPC ..... *H01R 13/5216* (2013.01); *H01R 43/005* (2013.01); *H01R 43/048* (2013.01)

(56) References Cited

U.S. PATENT DOCUMENTS

| | | | | |
|---|---|---|---|---|
| 2014/0302729 | A1* | 10/2014 | Kodama | H01R 4/62 439/877 |
| 2015/0020384 | A1* | 1/2015 | Yamamoto | H01R 4/185 29/863 |
| 2015/0357722 | A1* | 12/2015 | Sato | H01R 13/5216 439/877 |
| 2016/0359245 | A1* | 12/2016 | Aoki | H01R 4/185 |
| 2017/0005417 | A1 | 1/2017 | Aoki et al. | |
| 2017/0179615 | A1* | 6/2017 | Shinohara | H01R 4/185 |
| 2017/0179617 | A1* | 6/2017 | Yoshida | H01R 4/185 |
| 2017/0179637 | A1* | 6/2017 | Nakata | H01R 4/185 |
| 2018/0069327 | A1* | 3/2018 | Nakata | H01R 4/18 |
| 2018/0076532 | A1* | 3/2018 | Iwasawa | H01R 4/70 |
| 2018/0261931 | A1* | 9/2018 | Iwata | H01R 4/184 |
| 2019/0027883 | A1* | 1/2019 | Saito | H01R 4/185 |
| 2019/0036238 | A1* | 1/2019 | Maehori | H01B 1/023 |

FOREIGN PATENT DOCUMENTS

| | | | |
|---|---|---|---|
| JP | 2009-230998 | A | 10/2009 |
| JP | 2012-059438 | A | 3/2012 |
| JP | 2012-069449 | A | 4/2012 |
| JP | 5480368 | B2 | 4/2014 |
| JP | 2015-201269 | A | 11/2015 |
| JP | 5940198 | B2 | 6/2016 |

* cited by examiner

CRIMP TERMINAL

TECHNICAL FIELD

The present invention relates to a crimp terminal configured to be crimp-connected to a covered electric wire having an aluminum core wire.

BACKGROUND ART

In recent years, a covered electric wire having an aluminum core wire has been used for a wire harness in place of a covered electric wire having a copper core wire. Some crimp terminals such as connector terminals, for example, are made of a copper alloy or the like and having a surface that is tin-plated or gold-plated. When the crimp terminal of this type is crimped to an end portion of the covered electric wire where the aluminum core wire is exposed, contact between dissimilar metals occurs between the aluminum core wire and a crimping barrel portion of the crimp terminal. If moisture adheres to such contact portion, the aluminum core wire made of aluminum which is a base metal could be corroded due to so-called dissimilar metal corrosion.

Therefore, there has been proposed a crimp terminal having a seal member arranged to surround the contact portion between the barrel portion and the aluminum core wire (see, for example, Patent Document 1 and Patent Document 2). According to this type of crimp terminal, moisture can be prevented from entering the contact portion of the dissimilar metals, thus generation of dissimilar metal corrosion as described above can be avoided.

FIG. 29 shows an example of a conventional crimp terminal having a seal member arranged to surround a contact portion between a barrel portion and an aluminum core wire.

A crimp terminal 9 shown in FIG. 29 includes a barrel portion 91 and a terminal portion 92 arranged in a predetermined axial direction D91. The barrel portion 91 and the terminal portion 92 are produced from a metal plate made of a copper alloy or the like using sheet-metal processing and have a surface that is subjected to tin plating or gold plating. The barrel portion 91 is a portion that is wound around and crimped to an end portion W9*a* of a covered electric wire W9 having an aluminum core wire W91, where the aluminum core wire W91 is exposed. The terminal portion 92 is a female terminal configured to be connected to a pin terminal (not shown) as an object to be connected.

The barrel portion 91 is configured by bending the metal plate so that a cross section thereof intersecting with the axial direction D91 has a substantially U-like shape. After the end portion W9*a* of the covered electric wire W9 is placed on an inner surface 911 of the barrel portion 91, the barrel portion 91 is wound around and crimped to the end portion W9*a*. A part of the inner surface 911 of the barrel portion 91 serves as a contact portion 911*a* with the aluminum core wire W91 at the end portion W9*a*.

The contact portion 911*a* is provided with a serration 94 having a plurality of grooves arranged in rows in the axial direction D91, each groove extending in an intersecting direction D92 that intersects with the axial direction D91 in a plan view with respect to the contact portion 911*a*. When the barrel portion 91 is wound around and crimped to the end portion W9*a*, edges of the respective grooves of the serration 94 bite into the aluminum core wire W91, thereby obtaining good electrical continuity between the covered electric wire W9 and the crimp terminal 9.

A seal member 93 is provided so as to surround the contact portion 911*a*. When the barrel portion 91 is wound around and crimped to the end portion W9*a*, the sealing member 93 seals gaps at the respective locations around the contact portion 911*a* and prevents moisture from entering.

PRIOR ART DOCUMENT

Patent Document

Patent Document 1: JP 5480368 B
Patent Document 2: JP 5940198 B

SUMMARY OF THE INVENTION

Problem to be Solved by the Invention

However, the above-described conventional crimp terminal as shown as one example in FIG. 29 has a problem that the seal member 93 provided to the barrel portion 91 may be a hindrance to the winding and crimping of the barrel portion 91 to the end portion W9*a*.

In view of the above-described problem, an object of the present invention is to provide a crimp terminal that can reduce a difficulty of manufacturing while providing waterproof property with respect to a contact portion with aluminum core wire.

Solution to Problem

In order to achieve the above-described, the present invention provides a crimp terminal including a barrel portion configured to be wound around and crimped to an end portion of a covered electric wire having an aluminum core wire at which the aluminum core wire is exposed, and a terminal portion configured to be connected to a connection object, wherein the barrel portion and the terminal portion are arranged in a predetermined axial direction, wherein the barrel portion includes a bottom plate which extends in the axial direction and on which the end portion of the covered electric wire is to be placed, and an inner barrel piece and an outer barrel piece which extend from the bottom plate on both sides in an intersecting direction intersecting with the axial direction in a plan view with respect to the bottom plate, wherein the barrel portion is configured to be wound around the end portion, during crimping, with the inner barrel piece arranged inside, wherein an inner surface of the barrel portion is provided with a plurality of recesses arranged dispersedly, and a groove, wherein, of a first region traversing the outer barrel piece in the axial direction, a second region traversing the inner surface in the intersecting direction at a location close to the terminal portion and a third region traversing the inner surface in the intersecting direction so as to intersect with a covered portion of the end portion, the groove extends at least in the first region, wherein the crimp terminal includes a seal member formed from adhesive gel and configured to be attached over the first region, the second region and the third region, to seal, after the crimping, a space between the inner barrel piece and the outer barrel piece, an opening of the barrel portion formed cylindrical located on a side of the terminal portion, and a space between the covered portion and the barrel portion, wherein a portion of the seal member to be attached to the second region is formed into a strip-like shape having a width that allows a part of said portion to be pushed out from the opening after the crimping, and wherein a portion of the seal member to be attached to the first region is formed into a shape corresponding to the groove and having a narrower width than said portion of the seal member to be attached to the second region.

According to the crimp terminal of the present invention, edges of the respective recesses provided on the inner surface of the barrel portion dig into the aluminum core wire by the crimping, thereby providing good continuity between the covered electric wire and the crimp terminal. Furthermore, the crimp terminal of the present invention includes the seal member formed from adhesive gel and attached on the inner surface of the barrel portion, and the seal member seals, after the crimping, a space between the inner barrel piece and the outer barrel piece, the opening of the barrel portion formed cylindrical located on a side of the terminal portion, and a space between the covered portion and the barrel portion. Herein, in the crimp terminal of the present invention, the portion of the seal member to be attached to the second region is formed into a strip-like shape having a width that allows a part of said portion to be pushed out from the opening after the crimping, and the portion of the seal member to be attached to the first region is formed into a shape corresponding to the groove and having a narrower width than said portion of the seal member to be attached to the second region. Thus, the seal member provides waterproof property to the contact portion with the aluminum core wire all around the contact portion. Especially, with the portion formed into the strip-like shape with the width that allows the part thereof to be pushed out from the opening after the crimping, waterproof property is improved for the opening near the aluminum core wire. In addition, since the portion of the seal member to be attached to the first region is formed into a shape corresponding to the groove and having a narrower width than said portion of the seal member to be attached to the second region, the amount of the portion of the seal member to be attached to the first region is minimized. Consequently, the hindrance by the seal member during the crimping in which the winding and the crimping are performed with the inner barrel piece arranged inside, can be suppressed. Consequently, according to the crimp terminal of the present invention, difficulty of manufacturing can be reduced while securely providing waterproof property with respect to the contact portion with the aluminum core wire.

In the crimp terminal of the present invention, preferably, the groove is also provided in the third region so as to extend in the intersecting direction.

According to this crimp terminal of the preferable form, the groove provided in the third region serves to prevent displacement during the crimping of the portion of the seal member attached to the third region. Consequently, difficulty of manufacturing can be reduced even more.

Furthermore, in this crimp terminal of the preferable form, it is further preferable that a portion of the seal member to be attached to the third region is also formed into a shape corresponding to the groove and having a narrower width than said portion of the seal member to be attached to the second region.

According to this crimp terminal of the further preferable form, the amount of the portion to be attached to the third region can be minimized. Consequently, difficulty of manufacturing can be reduced even more.

Moreover, in the above-described crimping terminal of the preferable form in which the groove is provided in the third region, it is further preferable that a plurality of the grooves is extending in rows in the axial direction.

According to this crimping terminal of the further preferable form, the grooves are provided in rows in the axial direction in the third region intersecting with the covered portion that is likely to move and likely to be applied with force during the crimping. Consequently, displacement of the portion attached to this third region can be further prevented, thereby further reducing difficulty of manufacturing.

Advantageous Effect of the Invention

According to the present invention, the crimp terminal that can reduce a difficulty of manufacturing while providing waterproof property with respect to the contact portion with aluminum core wire, can be provided.

DESCRIPTION OF EMBODIMENTS

A first embodiment of the present invention will be explained below with showing modified examples thereof.

Figure 1:
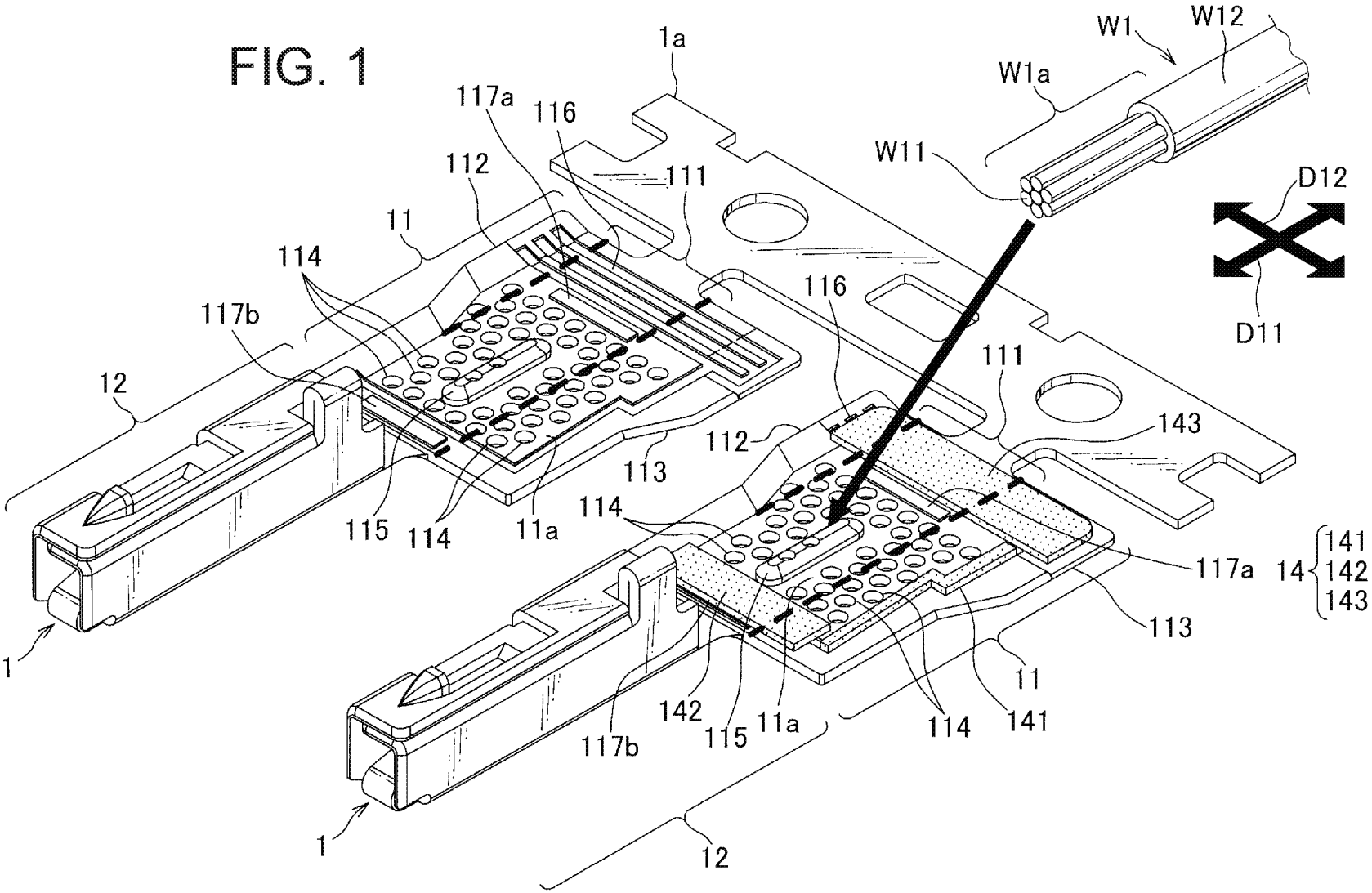
FIG. 1 illustrates a crimp terminal according to a first embodiment of the present invention.

FIG. 1 illustrates a crimp terminal according to the first embodiment of the present invention.

A crimp terminal 1 according to this embodiment is configured to be crimped to an end portion W1*a* of a covered electric wire W1 having an aluminum core wire W11, at which the aluminum core wire W11 is exposed. The crimp terminal 1 includes a barrel portion 11, a terminal portion 12 and a seal member 14. In FIG. 1, two crimp terminals 1 are shown, of which one crimp terminal 1 is shown with the seal member 14 removed for the purpose of providing a view of shape of an inner surface of the barrel portion 11.

The barrel portion 11 and the terminal portion 12 are produced from a metal plate made of a copper alloy or the like using punching and sheet-metal processing, and a surface thereof is tin-plated or gold-plated. The barrel portion 11 and the terminal portion 12 are arranged in a predetermined axial direction D11. In this embodiment, the barrel portions 11 and the terminal portions 12 are collectively formed in a state that a plurality of crimp terminals 1 is connected to each other by a strip-like connecting piece 1*a*. The barrel portion 11 is a plate-like portion that is to be wound around and crimped to the end portion W1*a* of the covered electric wire W1 so as to circumferentially wrap the aluminum core wire W11 and a covered portion W12. In this embodiment, this barrel portion 11 is a core wire-cover integrated barrel in which a portion for wrapping the aluminum core wire W11 and a portion for wrapping the covered portion W12 are integrally formed. The terminal portion 12 is a quadrangular tube-shaped female terminal configured to be connected to a pin terminal (not shown) as an object to be connected.

The barrel portion 11 includes a bottom plate 111, an inner barrel piece 112 and an outer barrel piece 113. The bottom plate 111 extends in the above-described axial direction D11. The inner barrel piece 112 and the outer barrel piece 113 extend from the bottom plate 111 on both sides in an intersecting direction D12 intersecting the axial direction D11 in a plan view with respect to the bottom plate 111. When being crimped to the end portion W1*a* of the covered electric wire W1, the barrel portion 11 is wound around the end portion W1*a* such that the inner barrel piece 112 is arranged inside and the outer barrel piece 113 is arranged outside, as described later.

A plurality of recesses 114 is dispersedly provided on an inner surface 11*a* of the barrel portion 11. Each recess 114 is formed into a circular shape in a plan view with respect to the inner surface 11*a* of the barrel portion 11. Furthermore, a protrusion 115 is formed on the bottom plate 111 of the barrel portion 11 at a position where the aluminum core wire W11 at the end portion W1*a* of the covered electric wire W1 is placed, and is formed by pressing applied from an outer surface side. Some of the plurality of recesses 114 are also formed on this protrusion 115.

A seal member 14 formed of an adhesive gel sheet is attached to the inner surface 11*a* of the barrel portion 11 so as to surround the plurality of recesses 114 from three sides in a plan view. The seal member 14 is attached as described below. Herein, examples of the adhesive gel sheet may include, but not limited to, those using acrylic adhesives.

Figure 2:
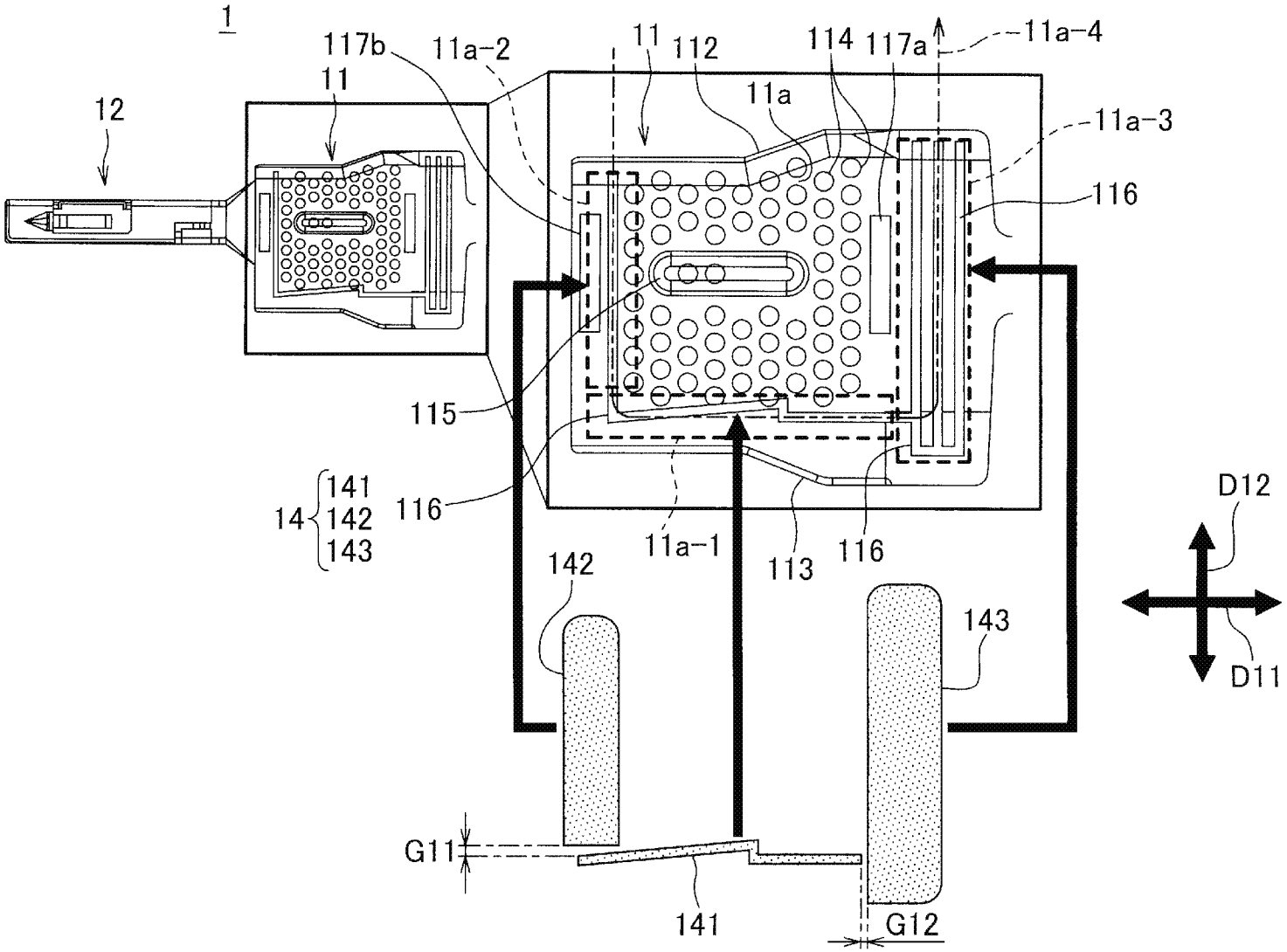
FIG. 2 illustrates how a seal member shown in FIG. 1 is attached to an inner surface of a barrel portion.

FIG. 2 illustrates how the seal member shown in FIG. 1 is attached to the inner surface of the barrel portion.

The seal member 14 is formed of an adhesive gel sheet and is arranged over three regions on the inner surface 11*a* of the barrel portion 11, namely a first region 11*a*-1, a second region 11*a*-2 and a third region 11*a*-3. The first region 11*a*-1 is a region that traverses the outer barrel piece 113 in the axial direction D11. The second region 11*a*-2 is a region that traverses the inner surface 11*a* in the intersecting direction D12 on a side closer to the terminal portion 12. The third region 11*a*-3 is a region that traverses the inner surface 11*a* in the intersecting direction D12 so as to intersect with the covered portion W12 of the end portion W1*a*.

As shown in FIGS. 1 and 2, in this embodiment, the seal member 14 is composed of three portions, namely, a first seal portion 141, a second seal portion 142 and a third seal portion 143. The first seal portion 141 extends in a strip-like shape in the axial direction D11 in the first region 11*a*-1. The second seal portion 142 extends in a strip-like shape in the intersecting direction D12 in the second region 11*a*-2. The third seal portion 143 extends in a strip-like shape in the intersecting direction D12 in the third region 11*a*-3.

In this embodiment, on the inner surface 11*a* of the barrel portion 11, a groove 116 is formed in the first region 11*a*-1, the second region 11*a*-2 and the third region 11*a*-3, so as to overlap with the seal member 14. In the first region 11*a*-1, one groove 116 extends in the axial direction D11 while bending in a sawtooth shape in the partway. In the second region 11*a*-2, one groove 116 extends linearly in the intersecting direction D12, and in the third region 11*a*-3, three grooves 116 extend linearly in the intersecting direction D12 and are joined on a side of the first region 11*a*-1. The plurality of recesses 114 is provided so as not to be located in the groove 116.

Furthermore, in this embodiment, the inner surface 11*a* of the barrel portion 11 is provided with a first indent 117*a* as a projection extending in the intersecting direction D12 and arranged at a location closer to a central portion of the barrel portion 11 than the third region 11*a*-3 in a plan view. Furthermore, there is provided a second indent 117*b* as a projection extending in the intersecting direction D12 and arranged at a location partially overlapping the second region 11*a*-2 and closer to the terminal portion 12 than the groove 116.

In this embodiment, the seal member 14 is attached in a divided manner that the seal member 14 is divided in the partway of a path 11*a*-4 extending from the second region 11*a*-2 through the first region 11*a*-1 to the third region 11*a*-3. Specifically, the seal member 14 is attached in a manner that both of the second seal portion 142 and the third seal portion 143 are divided from the first seal portion 141. The second seal portion 142 is attached so as to traverse the path 11*a*-4 in the axial direction D11 and in a manner divided from the first seal portion 141. On the other hand, the third seal portion 143 is attached so as to traverse the path 11*a*-4 in the intersecting direction D12 and in a manner divided from the first seal portion 141. A slight gap G11 is formed between the second seal portion 142 and the first seal portion 141, and a slight gap G12 is formed between the third seal portion 143 and the first seal portion 141.

Of the seal member 14, the second seal portion 142 that is to be attached to the second region 11*a*-2 is formed into a strip-like shape having a wide width designed to allow a part of the second seal portion 142 to be pushed out from an opening of the barrel portion 11 that is formed into a tubular shape after the crimping. On the other hand, the first seal portion 141 that is to be attached to the first region 11*a*-1 has a width narrower than the second seal portion 142, and is formed into a shape corresponding to the groove 116 in the first region 11*a*-1. Specifically, the first seal portion 141 is formed to have substantially the same width and substantially the same shape as the groove 116 so it can be received in the groove 116. The third seal portion 143 that is to be attached to the third region 11*a*-3 is formed into a strip-like shape having a width slightly wider than that of the second seal portion 142.

The first seal portion 141, the second seal portion 142 and the third seal portion 143 are attached so as to overlap the grooves 116 of the first region 11*a*-1, the second region 11*a*-2 and the third region 11*a*-3, respectively. Especially, the first seal portion 141 is attached so as to be received in the groove 116, as described above.

The crimp terminal 1 described above is manufactured as follows.

Firstly, a sheet-metal processing step for forming a structural object prior to the attachment of the seal member 14 is performed. In the sheet-metal processing step, the barrel portion 11 is formed together with the terminal portion 12 from the metal plate. As described above, in this embodiment, in the sheet-metal processing step, the barrel portion 11 and the terminal portion 12 are collectively formed with the plurality of crimp terminals 1 connected together by the strip-like connecting piece 1*a*. In this sheet-metal processing step, the formation of the plurality of recesses 114, the formation of the protrusion 115 and the formation of the grooves 116 on the inner surface 11*a* of the barrel portion 11 are also performed.

Subsequently, a seal member attaching step is performed in which the seal member 14 is formed from an adhesive gel sheet, and the seal member 14 is attached over the first region 11*a*-1, the second region 11*a*-2 and the third region 11*a*-3. This seal member attaching step is a step for attaching the seal member 14 in a manner that the seal member 14 is divided in the partway of the path 11*a*-4 extending from the second region 11*a*-2 through the first region 11*a*-1 to the third region 11*a*-3. In other words, the first seal portion 141, the second seal portion 142 and the third seal portion 143 are individually attached to the inner surface 11*a* of the barrel portion 11.

In the seal member attaching step, the first seal portion 141, the second seal portion 142 and the third seal portion 143 are punched out from the adhesive gel sheet and attached to the inner surface 11*a* of the barrel portion 11. By pushing the adhesive gel sheet toward each of the attachment locations on the inner surface 11*a* of the barrel portion 11 while punching out the adhesive gel sheet with a cutter for punching out each seal portion, the punching out and the attaching are performed at approximately the same time. Furthermore, at this time, the second seal portion 142 is attached so as to overlap a part of the second indent 117*b*, and the third seal portion 143 is attached such that the first indent 117*a* is exposed.

The crimp terminal 1 manufactured as described above is crimped to the end portion W1*a* of the covered electric wire W1 using a terminal connecting method described below.

Figure 3:
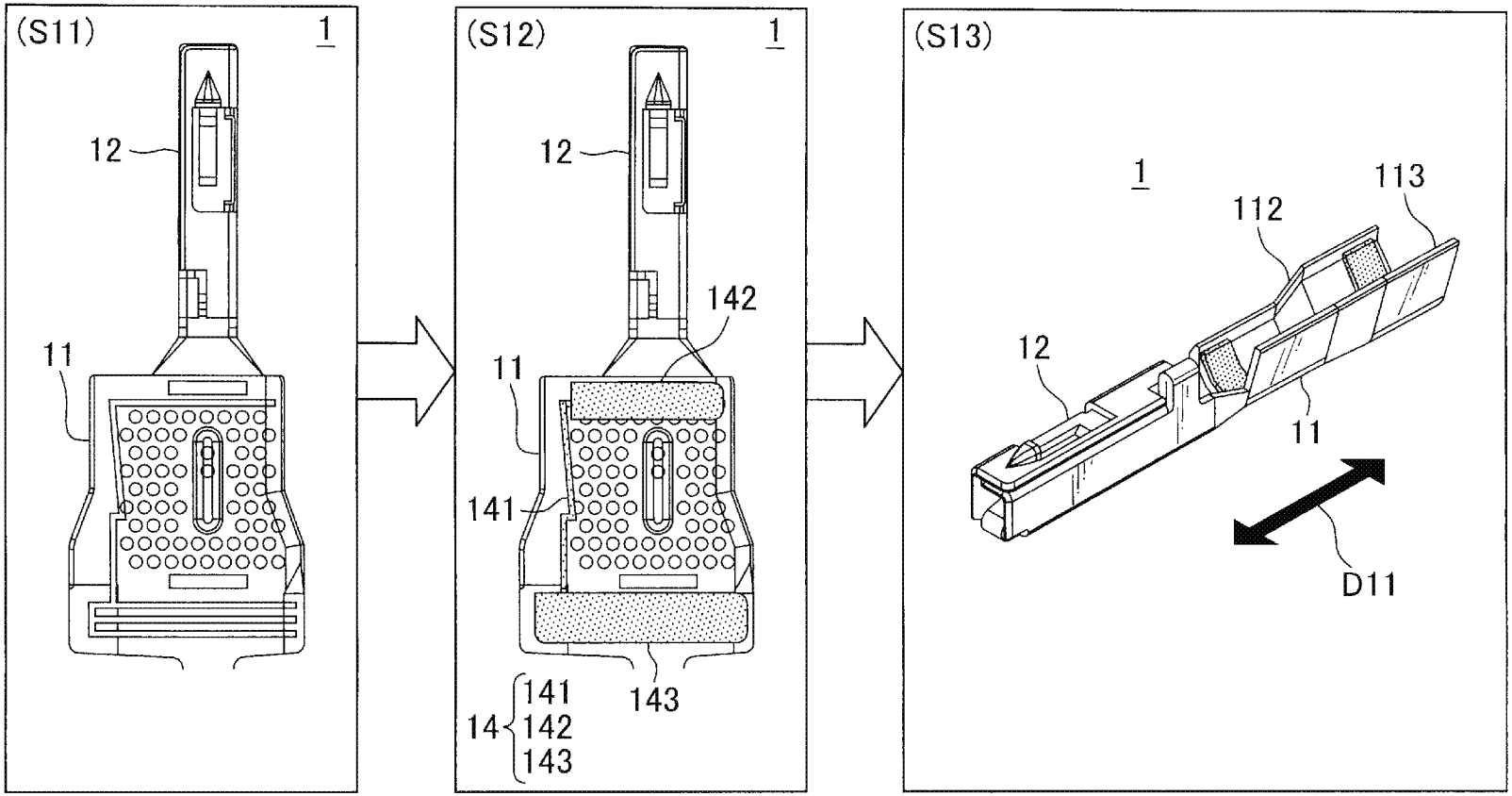
FIG. 3 illustrates a procedure for completing preparation of the crimp terminal shown in FIGS. 1 and 2 that is ready to be crimped to an end portion of a covered electric wire using a terminal connecting method.
Figure 4:
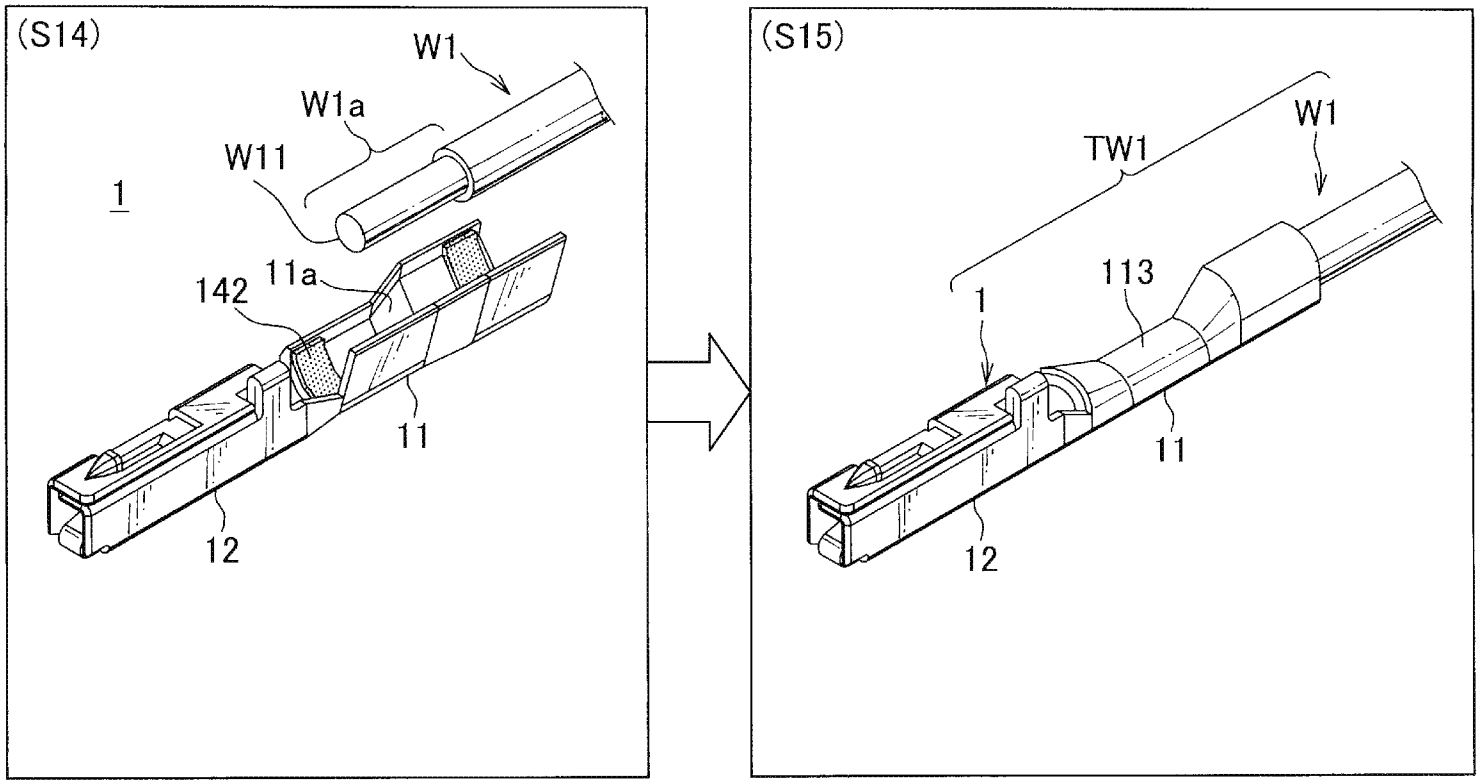
FIG. 4 illustrates a procedure, that follows the procedure shown in FIG. 3, for crimping the crimp terminal to the end portion of the covered electric wire.

FIG. 3 illustrates a procedure for completing preparation of the crimp terminal shown in FIGS. 1 and 2 that is ready to be crimped to the end portion of the covered electric wire using the terminal connecting method, and FIG. 4 illustrates a procedure, that follows the procedure shown in FIG. 3, for crimping the crimp terminal to the end portion of the covered electric wire.

FIG. 3 also shows the sheet-metal processing step (S11) and the seal member attaching step (S12) in the terminal manufacturing method described above. The barrel portion 11 and the terminal portion 12 are formed in the sheet-metal processing step (S11), and the first seal portion 141, the second seal portion 142 and the third seal portion 143 constituting the seal member 14 are attached in the seal member attaching step (S12).

When crimping to the end portion W1*a* of the covered electric wire W1, firstly, the crimp terminal 1 to be crimped is detached from the connecting piece 1*a* shown in FIG. 1. Then, bending deformation is performed with respect to the barrel portion 11 of that crimp terminal 1 as preparation for placing the end portion W1*a* of the covered electric wire W1 (S13). This bending deformation is performed such that the inner barrel piece 112 and the outer barrel piece 113 are brought close to each other so that the cross section intersecting with the axial direction D11 is formed into a substantially U-like shape.

Subsequently, a placing step for placing the end portion W1*a* of the covered electric wire W1 on the inner surface 11*a* of the barrel portion 11 after subjected to the bending deformation is performed (S14), as described below.

Figure 5:
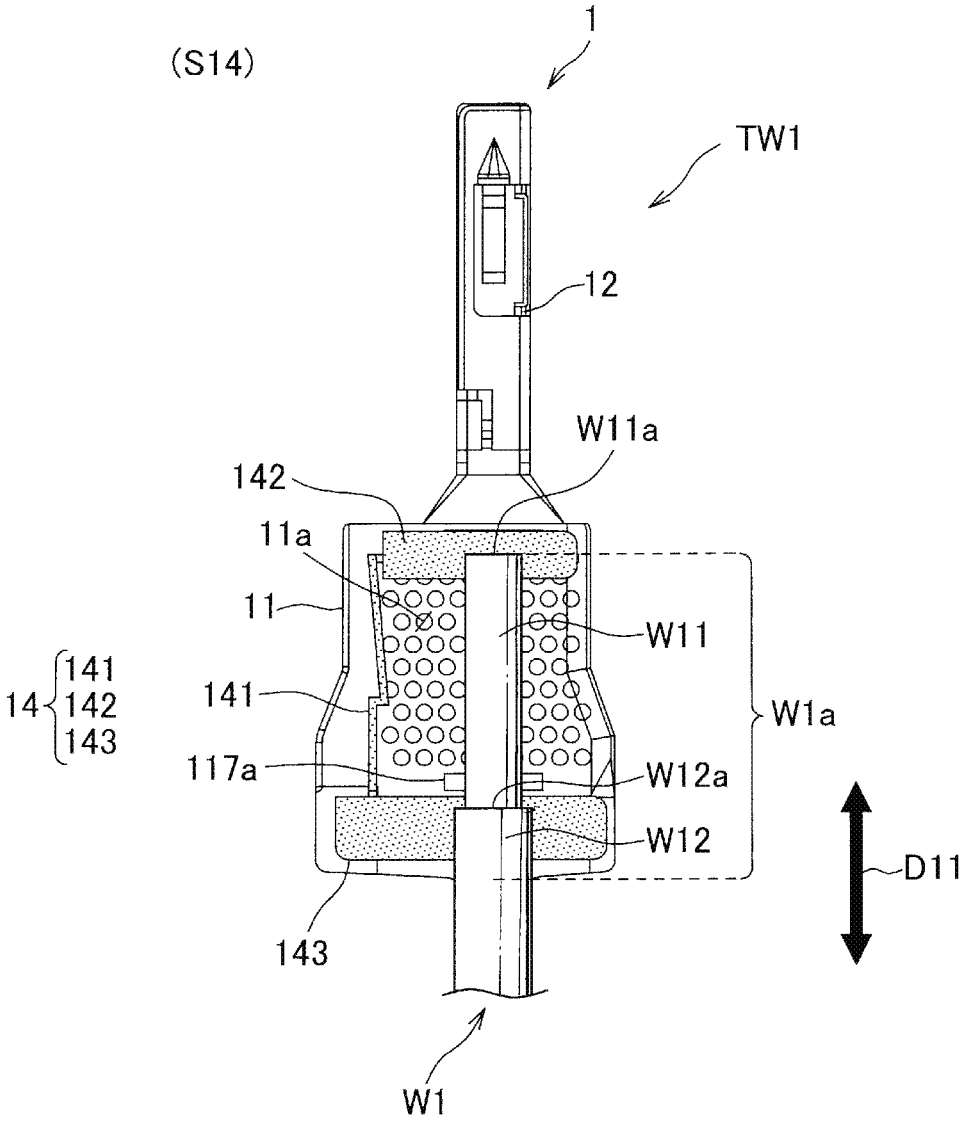
FIG. 5 illustrates a placing step shown in FIG. 4 in a plan view with respect to the inner surface of the barrel portion.

FIG. 5 illustrates a placing step shown in FIG. 4 in a plan view with respect to the inner surface of the barrel portion. In FIG. 5, the barrel portion 11 that is shown in FIG. 4 in the bent shape is shown in a state of being extended along a plane, in order to provide a clear view of the positional relationship of the end portion W1*a* of the covered electric wire W1 and the respective portions of the inner surface 11*a* of the barrel portion 11.

In the placing step (S14), the end portion W1*a* is placed on the inner surface 11*a* of the barrel portion 11 along the axial direction D11, such that a tip W11*a* of the aluminum core wire W11 at the end portion W1*a* overlaps the second seal portion 142 of the seal member 14. Furthermore, in this placing step (S14), the end portion W1*a* is placed on the inner surface 11*a* of the barrel portion 11 such that a tip W12*a* of the covered portion W12 overlaps the third seal portion 143 of the seal member 14. Furthermore, in this placing step (S14), the exposed portion of the aluminum core wire W11 is placed so as to contact with the first indent 117*a*.

Following the placing step (S14) described above, a crimping step for winding around and crimping the barrel portion 11 to the end portion W1*a* such that the outer barrel piece 113 is overlapped on the inner barrel piece 112 with the inner barrel piece 112 arranged inside as shown in FIG. 4, is performed (S15). This crimping step (S15) provides a finished electric wire with terminal TW1 in which the crimp terminal 1 is connected to the covered electric wire W1.

In the crimping step (S15) described above, the seal member 14 seals the respective portions of the crimp terminal 1 as explained below to form the electric wire with terminal TW1.

Figure 6:
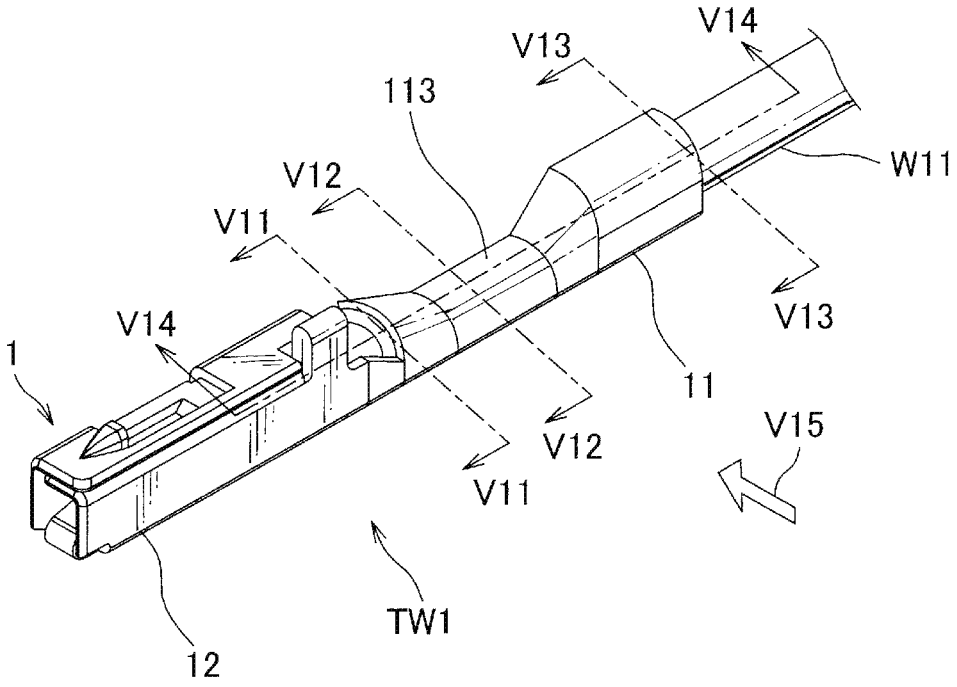
FIG. 6 shows an electric wire with terminal after the crimping that is also shown in FIG. 4.
Figure 7:
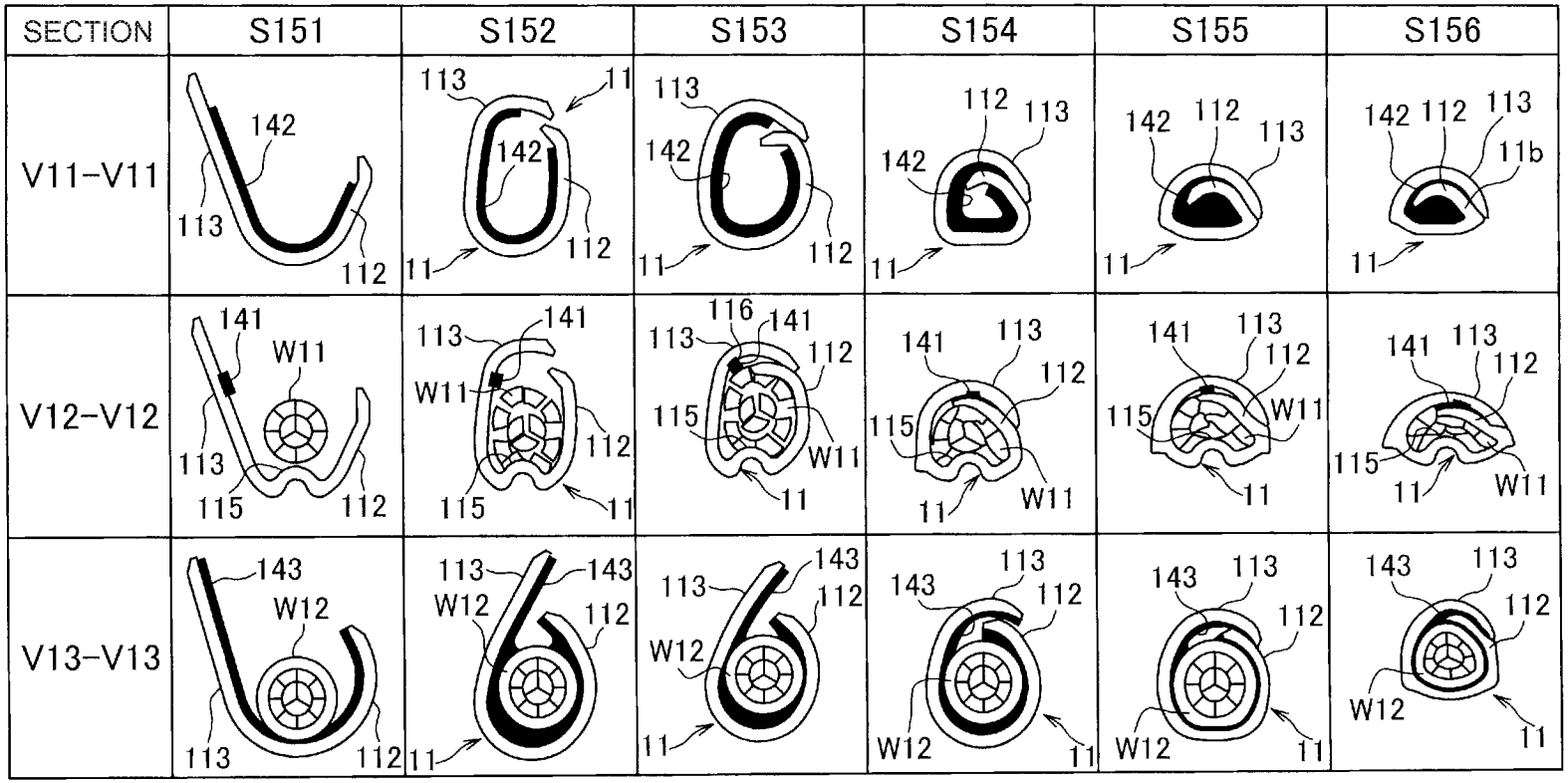
FIG. 7 shows changes during a crimping step in a cross section taken along line V11-V11, a cross section taken along line V12-V12, and a cross section taken along line V13-V13 in FIG. 6.

FIG. 6 shows the electric wire with terminal after the crimping that is also shown in FIG. 4. FIG. 7 shows changes during the crimping step in a cross section taken along line V11-V11, a cross section taken along line V12-V12, and a cross section taken along line V13-V13 in FIG. 6.

In the first step (S151) of the crimping step, bending of the inner barrel piece 112 and the outer barrel piece 113 is started such that the inner barrel piece 112 and the outer barrel piece 113 are wound around the aluminum core wire W11 on the protrusion 115 and around the covered portion W12 in the vicinity thereof. At this time, the positional relationship is such that, the first seal portion 141 is in contact with the aluminum core wire W11, the third seal portion 143 is in contact with the covered portion W12, and most part of the second seal portion 142 is substantially not in contact with any of the aluminum core wire W11 and the covered portion W12. In the second step (S152) and the third step (S153) where the winding is slightly advanced, the barrel portion 11 is formed into a tubular shape. Then, the first seal portion 141 is sandwiched between the inner barrel piece 112 and the outer barrel piece 113, and the third seal portion 143 is elongated while being sandwiched between the covered portion W12 and the barrel portion 11.

At this time, according to this embodiment, since the first seal portion 141 is formed with a width and a shape corresponding to the groove 116, the amount of the seal member 14 sandwiched between the inner barrel piece 112 and the outer barrel piece 113 is minimized. If there is excessive amount of the seal member 14 at this portion, then the outer barrel piece 113 may be hardly movable with respect to the inner barrel piece 112 during the winding, possibly causing hindrance to the crimping. However, in this embodiment, since the amount of the seal member 14 at this portion is suppressed, such hindrance by the seal member 14 during the crimping is suppressed.

In the fourth step (S154), the fifth step (S155) and the sixth step (S156) where pressure is applied to the aluminum core wire W11 and such, the edges of the plurality of recesses 114 dig into the aluminum core wire W11. Also, at that time, strands of the aluminum core wire W11 are separated and spread by the protrusion 115 located underneath the aluminum core wire W11, thus the number of strands contacting the barrel portion 11 is increased. The elongation of the seal member 14 progresses simultaneously.

Here, as described above, in this embodiment, the slight gap G11 is formed between the second seal portion 142 and the first seal portion 141, and the slight gap G12 is formed between the third seal portion 143 and the first seal portion 141. These gaps G11, G12 are closed by the above-described elongation of the seal member 14 during the crimping.

Figure 8:
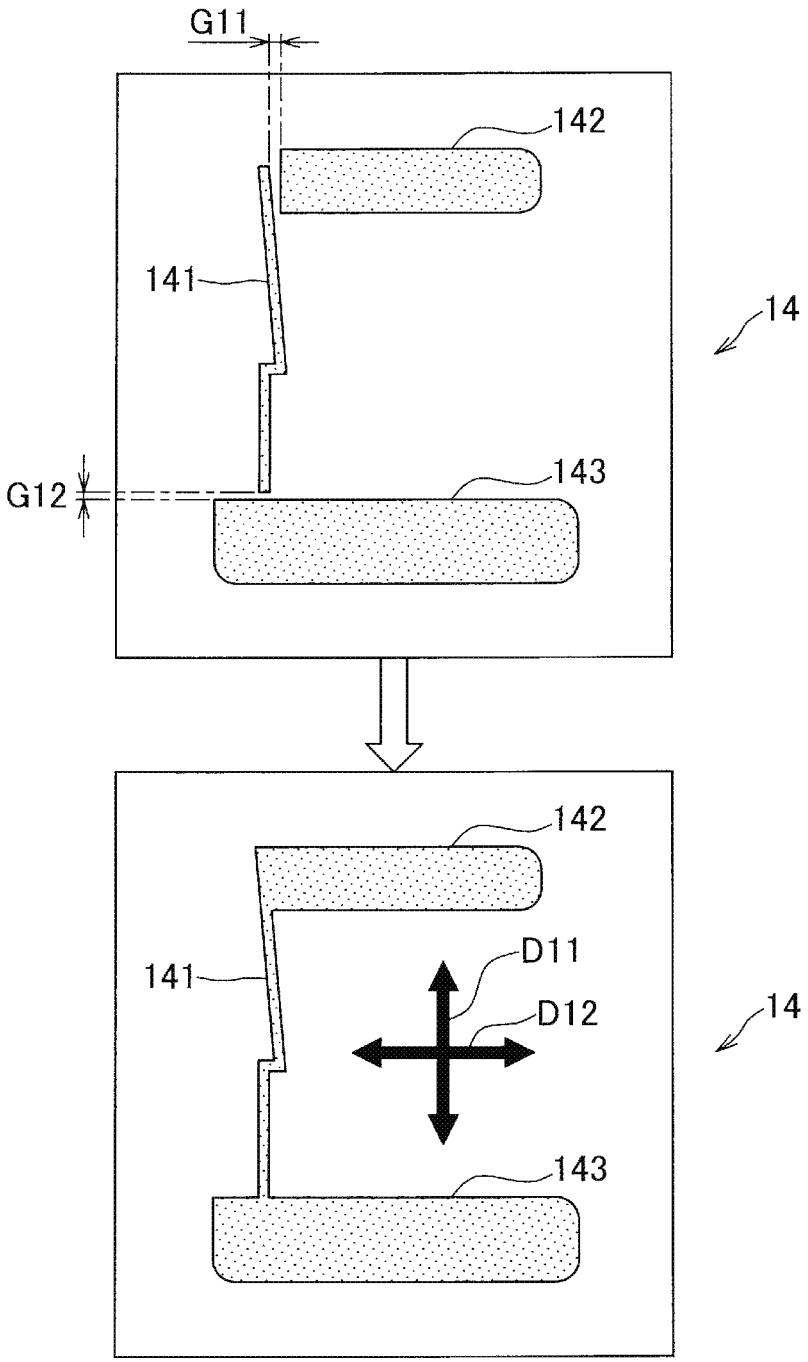
FIG. 8 is a schematic view showing how a gap between a second seal portion and a first seal portion and a gap between a third seal portion and the first seal portion shown in FIG. 2 are closed by elongation of the seal member during the crimping.

FIG. 8 is a schematic view showing how the gap between the second seal portion and the first seal portion and the gap between the third seal portion and the first seal portion shown in FIG. 2 are closed by the elongation of the seal member during the crimping.

As shown in FIG. 8, during the crimping, the second seal portion 142 is elongated in the intersecting direction D12 which coincides with a length direction of the second seal portion 142. Due to this elongation, the second seal portion 142 is connected to the first seal portion 141, thereby closing the gap G11 between them. On the other hand, the first seal portion 141 is elongated in the axial direction D11 which coincides with a length direction of the first seal portion 141. Due to this elongation, the first seal portion 141 is connected to the third seal portion 143, thereby closing the gap G12 between them.

Next, in the sixth step (S156), a space between the inner barrel piece 112 and the outer barrel piece 113, an opening 11*b* of the tubular barrel portion 11 on a side of the terminal portion 12, and a space between the covered portion W12 and the barrel portion 11 are sealed by the elongated seal member 14.

Figure 9:
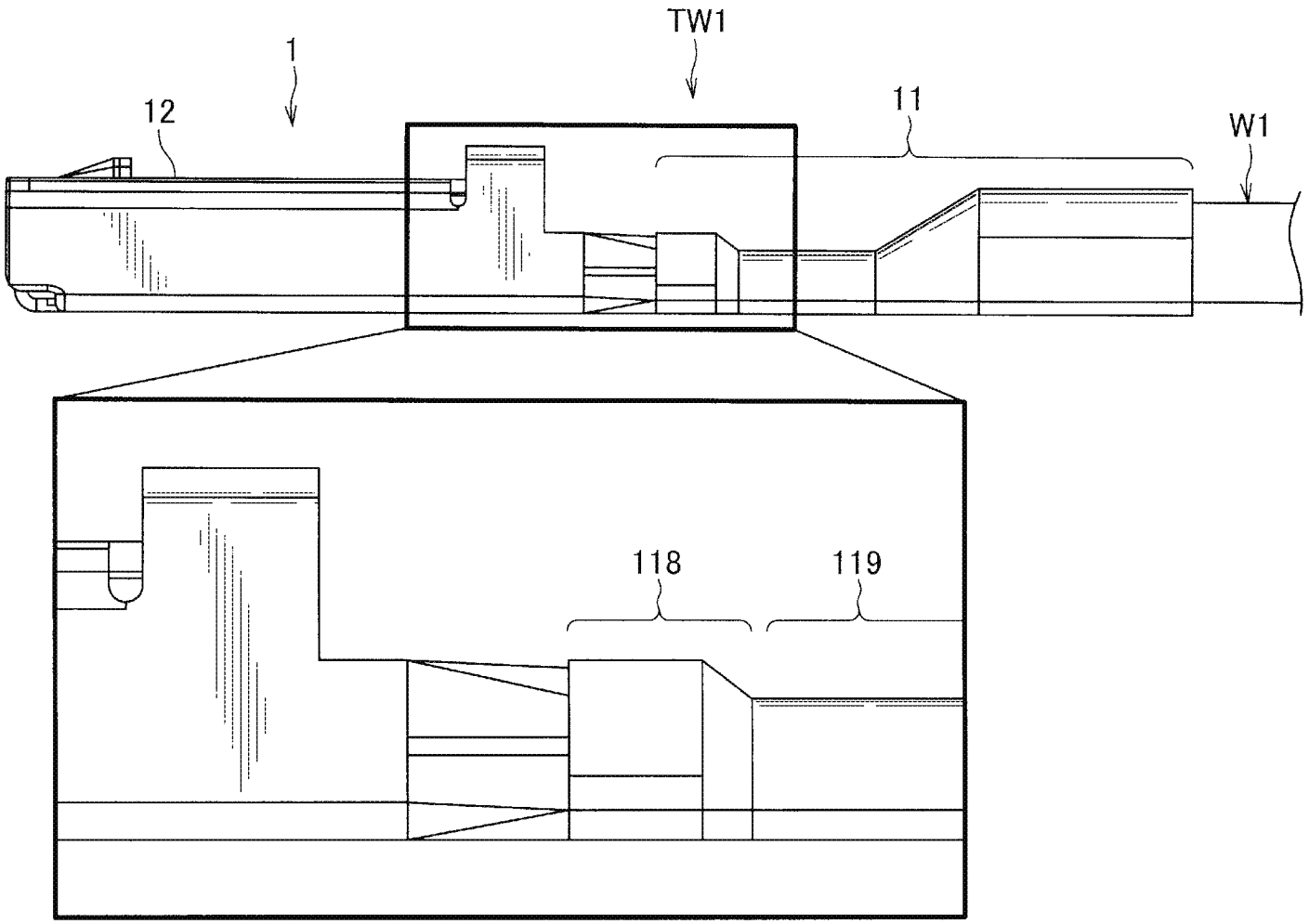
FIG. 9 is a side view of the electric wire with terminal shown in FIG. 6 viewed from a direction indicated with an arrow V15 in FIG. 6.
Figure 10:
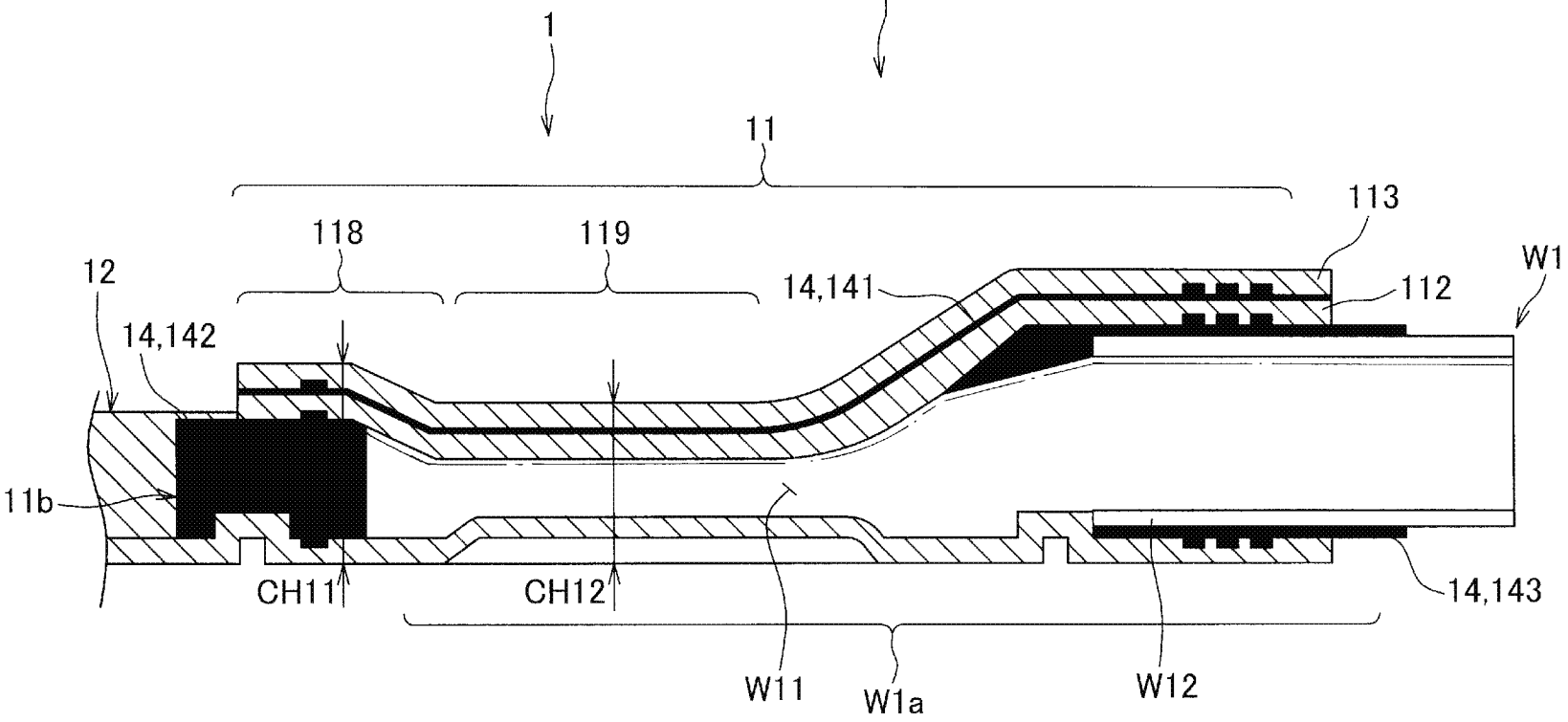
FIG. 10 is a cross sectional view taken along line V14-V14 shown in FIG. 6.

FIG. 9 is a side view of the electric wire with terminal shown in FIG. 6 viewed from a direction indicated with an arrow V15 in FIG. 6, and FIG. 10 is a cross sectional view taken along line V14-V14 shown in FIG. 6.

As shown in FIG. 10, the space between the inner barrel piece 112 and the outer barrel piece 113 is sealed by the first seal portion 141, and the opening 11*b* of the barrel part 11 on the side of the terminal portion 12 is sealed by the second seal portion 142. Furthermore, the space between the covered portion W12 and the barrel portion 11 is sealed by the third seal portion 143.

In this embodiment, in an up-down direction in FIG. 10 in which pressure is mainly applied in the crimping, a dimension of the barrel portion 11 on the side of the terminal portion 12 (thereinafter called, "front end portion 118") after the crimping (hereinafter called, "crimp height CH11"), is set to be the following dimension. That is, the crimping is performed such that the crimp height CH11 of this front end portion 118 is greater than a crimp height CH12 of a crimp portion 119 of the aluminum core wire W11.

Herein, the second seal portion 142 of the seal member 14 located on the side of the terminal portion 12 is formed into a strip-like shape having a width designed to allow a part of the second seal portion 142 to be pushed out from the opening 11*b* of the barrel portion 11 after the crimping, as described above. Thus, as shown in FIG. 10, a part of the seal member 14 projects from the opening 11*b* of the front end portion 118 formed with the above-described crimp height CH11. In other words, the crimp height CH11 of the front end portion 118 is set to a dimension that makes the tubular barrel portion 11 crushed to the extent that such projection of the seal member 14 is formed.

Due to the projection of the seal member 14 from the opening 11*b*, the opening 11*b* of the barrel portion 11 is sealed at a high level. Furthermore, also at the side of the barrel portion 11 at which the covered electric wire W1 is extending out, a part of the seal member 14 projects out from between the covered portion W12 and the barrel portion 11, thereby sealing this portion at a high level. On the other hand, the space between the inner barrel piece 112 and the outer barrel piece 113 is sealed by the first seal portion 141 of minimum amount that is formed to have the width and the shape corresponding to the groove 116. Consequently, the sealing at the respective portion of the barrel portion 11 can be performed while suppressing the hindrance to the crimping by the seal member 14.

Furthermore, by forming each portion of the seal member 14 so as to project from the opening 11*b* of the barrel portion 11 and from the side of the barrel portion 11 at which the covered electric wire W1 extends out, it is possible to visually check that these portions are securely sealed with the seal member 14 after the crimping. Moreover, by setting the crimp height CH12 of the crimp portion 112 to be relatively small as described above, the bonding with the aluminum core wire W11 can be enhanced, thereby improving the reliability of contact with the crimp terminal 1.

In the embodiment described above, the crimping causes the edges of the respective recesses 114 provided on the inner surface 11*a* of the barrel portion 11 to dig into the aluminum core wire W11, thereby providing good continuity between the covered electric wire W1 and the crimp terminal 1. Furthermore, the seal member 14 is attached to the inner surface 11*a* of the barrel portion 11, the seal member 14 being configured to seal, after the crimping, the space between the inner barrel piece 112 and the outer barrel piece 113, the opening 11*b* of the barrel portion 11, that is formed into a tubular shape, on the side of the terminal portion 12, and the space between the covered portion W12 and the barrel portion 11. In this embodiment, the second seal portion 142 of the seal member 14 that is to be attached to the second region 11*a*-2 is formed into the strip-like shape having a width designed to allow a part of the second seal portion 142 to be pushed out from the opening 11*b* after the crimping. On the other hand, the first seal portion 141 that is to be attached to the first region 11*a*-1 is formed to have a width and a shape corresponding to the groove 116. The seal member 14 provides waterproof property with respect to the contact portion with the aluminum core wire W11 throughout the entire circumference thereof. Especially, waterproof property at the opening lib near the aluminum core wire W11 has been improved by the second seal portion 142 that is formed into the strip-like shape having the width designed to allow a part thereof to be pushed out from the opening 11*b* after the crimping. Furthermore, by forming the first seal portion 141 to have the width and the shape corresponding to those of the groove 116 in the first region 11*a*-1, the amount of the first seal portion 141 can be minimized, thereby suppressing the hindrance by the seal member 14 during the crimping in which the winding and the crimping are performed with the inner barrel piece 112 arranged inside. Consequently, according to this embodiment, difficulty of manufacturing can be reduced while securely providing waterproof property with respect to the contact portion with the aluminum core wire W11.

In this embodiment, the groove 116 is also provided to the third region 11*a*-3 so as to extend in the intersecting direction D12. The groove 116 provided to the third region 11*a*-3 serves to prevent the displacement of the third seal portion 143 during the crimping, thereby further reducing difficulty of manufacturing. Similarly, the groove 116 is also provided to the second region 11*a*-2 so as to extend in the intersecting direction D11. The groove 116 provided to this second region 11*a*-2 serves to prevent the displacement of the second seal portion 142 during the crimping. Consequently, according to this embodiment, the displacement during the crimping can be prevented for all of the attachment positions, thereby further reducing difficulty of manufacturing.

Furthermore, in this embodiment, for the third region 11*a*-3, the grooves 116 are provided to extend in three rows in the axial direction D11. Thus, the three rows of the grooves 116 are provided in the third region 11*a*-3 intersecting with the covered portion W12 that is likely to move and likely to be applied with force during the crimping, for example, thereby further preventing displacement of the third seal portion 143 attached to this third region 11*a*-3. Consequently, difficulty of manufacturing can be reduced even more.

Furthermore, in the terminal connecting method according to this embodiment that has been explained above in reference to FIGS. 3 and 4, in the above-described placing step (S14), the end portion W1*a* of the covered electric wire W1 is placed onto the inner surface 11*a* of the barrel portion 11 as follows. That is, the end portion W1*a* of the covered electric wire W1 is placed such that the tip W11*a* of the aluminum core wire W11 overlaps the second seal portion 142 of the seal member 14 located on a side of the terminal portion 12. Consequently, a part that is located off, even if only slightly, from the second seal portion 142 in the axial direction D1 can immediately contribute to electrical continuity with the aluminum core wire W1*l*. As a result, the electrical conductivity between the aluminum core wire W11 and the crimp terminal 1 is securely and sufficiently obtained. Consequently, according to the terminal connecting method of this embodiment, the electrical conductivity between the exposed aluminum core wire W11 and the crimp terminal 1 can be securely and sufficiently obtained, while securely providing waterproof property with respect to the contact portion with the aluminum core wire W11.

In this embodiment, the placing step (S14) includes placing the end portion W1*a* on the inner surface 11*a* of the barrel portion 11 such that the tip W12*a* of the covered portion W12 overlaps the third seal portion 143. Thus, a part between the second seal portion 142 and the third seal portion 143 in the axial direction D11 contributes to the electrical continuity with the aluminum core wire W11 throughout substantially the entire length. Consequently, electrical conductivity between the exposed aluminum core wire W11 and the crimp terminal 1 can be improved even more.

Furthermore, in the electric wire with terminal TW1 according to this embodiment, the first indent 117*a* extending in the intersecting direction D12 is provided at a location not overlapping with the seal member 14 and close to the third region 11*a*-3, as shown in FIG. 2. Furthermore, as shown in FIG. 5, the barrel portion 11 is crimped to the end portion W1*a* of the covered electric wire W1 such that the aluminum core wire W11 contacts with the first indent 117*a*.

After the crimping, the first indent 117*a* extending in the intersecting direction D12 functions to resist the return of the barrel portion 11. At this time, if the seal member 14 made of flexible adhesive gel is wound around the end portion W1*a* in a manner overlapped with the first indent 117*a*, it could behave as follows. That is, a part overlapped with the first indent 117*a* may act as a cushion during the crimping and expand a winding diameter at the first indent 117*a*, lowering the above-described function of the first indent 117*a*.

However, according to this embodiment, the crimping is performed such that the aluminum core wire W11 contacts with the first indent 117*a*, thus the first indent 117*a* is wound in a manner directly contacting with the aluminum core wire W11 without the seal member 14 between the first indent 117*a* and the aluminum core wire W11. Consequently, the first indent 117*a* can resist the return of the barrel portion 11 without being affected by the seal member 14. Also, since the first indent 117*a* is wound without a cover of the covered electric wire W1 between the first indent 117*a* and the aluminum core wire W11, the winding diameter can be reduced further for the thickness of this cover. Thus, in this regard also, the first indent 117*a* can successfully resist the return of the barrel portion 11. As a result, the return of the barrel portion 11 can successfully be suppressed. Consequently, according to this embodiment, the return of the barrel portion 11 can be suppressed while securely providing the waterproof property with respect to the contact portion with the aluminum core wire W11. In addition, with the first indent 117*a* being directly contacting with the aluminum core wire W11, the electrical conductivity between the aluminum core wire W11 and the crimp terminal 1 can be securely and sufficiently obtained.

In this embodiment, as shown in FIG. 2, the inner surface 11*a* of the barrel portion 11 is also provided with the second indent 117*b* extending in the intersecting direction D12, at a location close to the terminal portion 12. Consequently, the return of the barrel portion 11 can successfully be suppressed on both sides of the barrel portion 11, i.e., on the side close to the terminal portion 12 and on the side opposite thereof.

Furthermore, in this embodiment, the first indent 117*a* and the second indent 117*b* that are obtained by the sheet-metal processing are applied as the projections on the inner surface 11*a* of the barrel portion 11. In general, the indent is highly resistant to the return as described above, thus the return of the barrel portion 11 can be suppressed even more successfully.

Furthermore, in this embodiment, as shown in FIG. 5, the barrel portion 11 is configured to be crimped to the end portion W1*a* such that the tip W12*a* of the covered portion W12 at the end portion W1*a* of the covered electric wire W1 overlaps the third seal portion 143. Thus, in this embodiment, the first indent 117*a* is provided as close to the third region 11*a*-3 as possible. According to this embodiment, the aluminum core wire W11 is allowed to contact with the first indent 117*a* that is positioned at such location, thereby effectively suppressing the return of the barrel portion 11 in the vicinity of the edge of the barrel portion 11.

Furthermore, in the terminal connecting method according to this embodiment as explained in reference to FIGS. 3 and 4, in the placing step (S14) described above, the end portion W1*a* is placed on the inner surface 11*a* of the barrel portion 11 such that the aluminum core wire W11 contacts with the first indent 117*a*. Thus, as described above, the first indent 117*a* can successfully suppress the return of the barrel portion 11 without being affected by the seal member 14. Consequently, according to the terminal connecting method of the this embodiment, the return of the barrel portion 11 can be suppressed, while securely providing waterproof property with respect to the contact portion with the aluminum core wire W11.

Furthermore, in the terminal connecting method according to this embodiment, the placing step (S14) includes placing the end portion W1*a* on the inner surface 11*a* of the barrel portion 11 such that the tip W12*a* of the covered portion W12 overlaps the third seal portion 143. Consequently, the return of the barrel portion 11 can be effectively suppressed in the vicinity of the edge of the barrel portion 11, as described above.

Furthermore, in the terminal connecting method according to this embodiment, the placing step (S14) includes placing the end portion W1*a* onto the inner surface 11*a* of the barrel portion 11 such that the tip W11*a* of the aluminum core wire W11 overlaps the second seal portion 142. Consequently, the electrical conductivity between the aluminum core wire W11 and the crimp terminal 1 can be sufficiently and securely obtained, as described above.

Next, various modified examples of the above-described embodiment will be explained.

Figure 11:
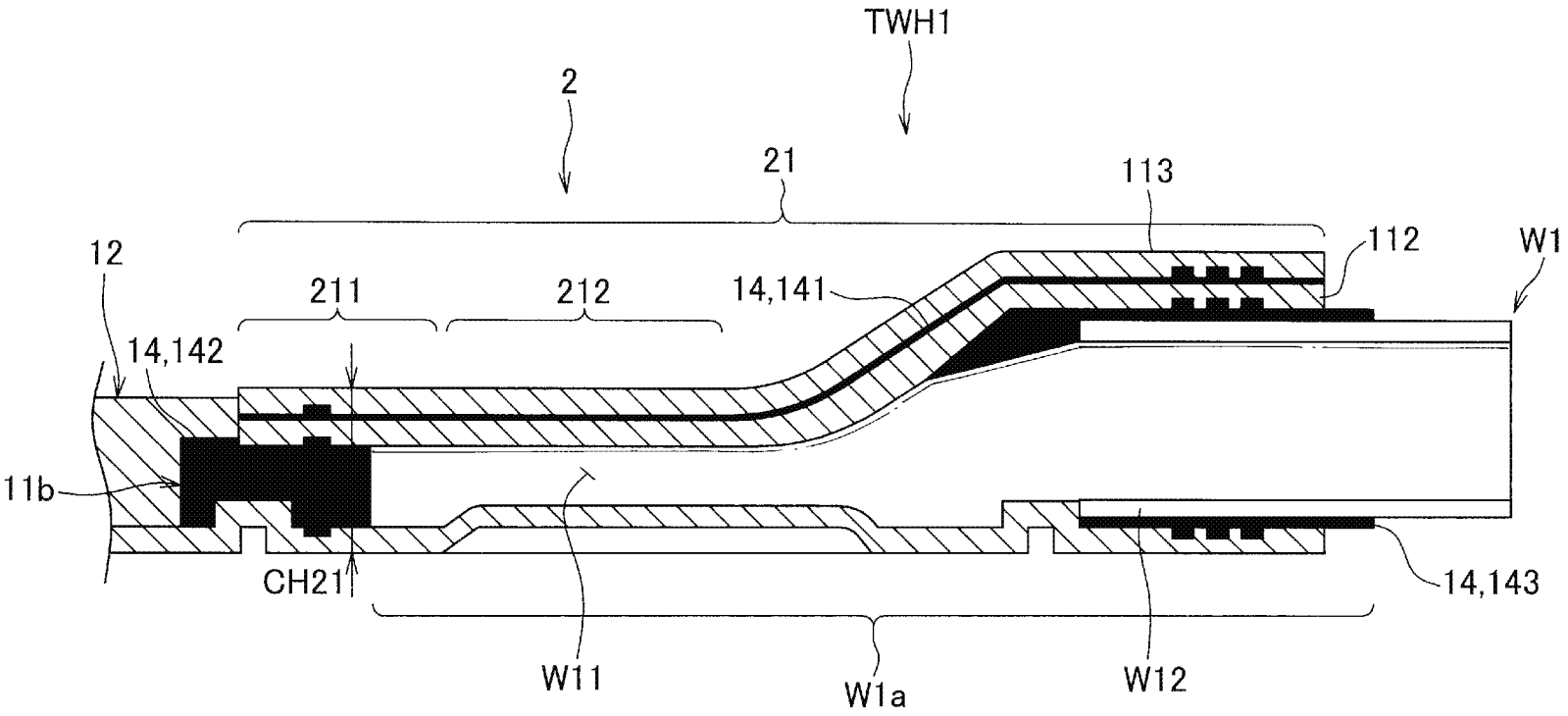
FIG. 11 shows a first modified example with respect to the embodiment shown in FIGS. 1-10.

FIG. 11 shows a first modified example with respect to the embodiment shown in FIGS. 1-10. In FIG. 11, elements similar to those shown in FIGS. 1-10 are denoted by the same reference signs, and explanation of these similar elements is omitted. This is the same for explanation and the drawings to which reference is made for later-described other modified examples.

In an electric wire with terminal TWH1 according to the first modified example, a crimp terminal 2 is crimped such that substantially the same crimp height CH21 is obtained at a front end portion 211 and a crimp portion 212 of the aluminum core wire W11 of a barrel portion 21 after the crimping. Furthermore, the second seal portion 142 of the seal member 14 is formed into a strip-like shape having a width designed to allow a part of the second seal portion 142 to be pushed out from the opening 11*b* with this crimp height CH21. In this first modified example also, the opening 11*b* that requires relatively large amount for the sealing is sealed by the second seal portion 142 having the width as described above, while suppressing the hindrance to the crimping by the seal member 14 with the first seal portion 141 of minimum amount.

Figure 12:
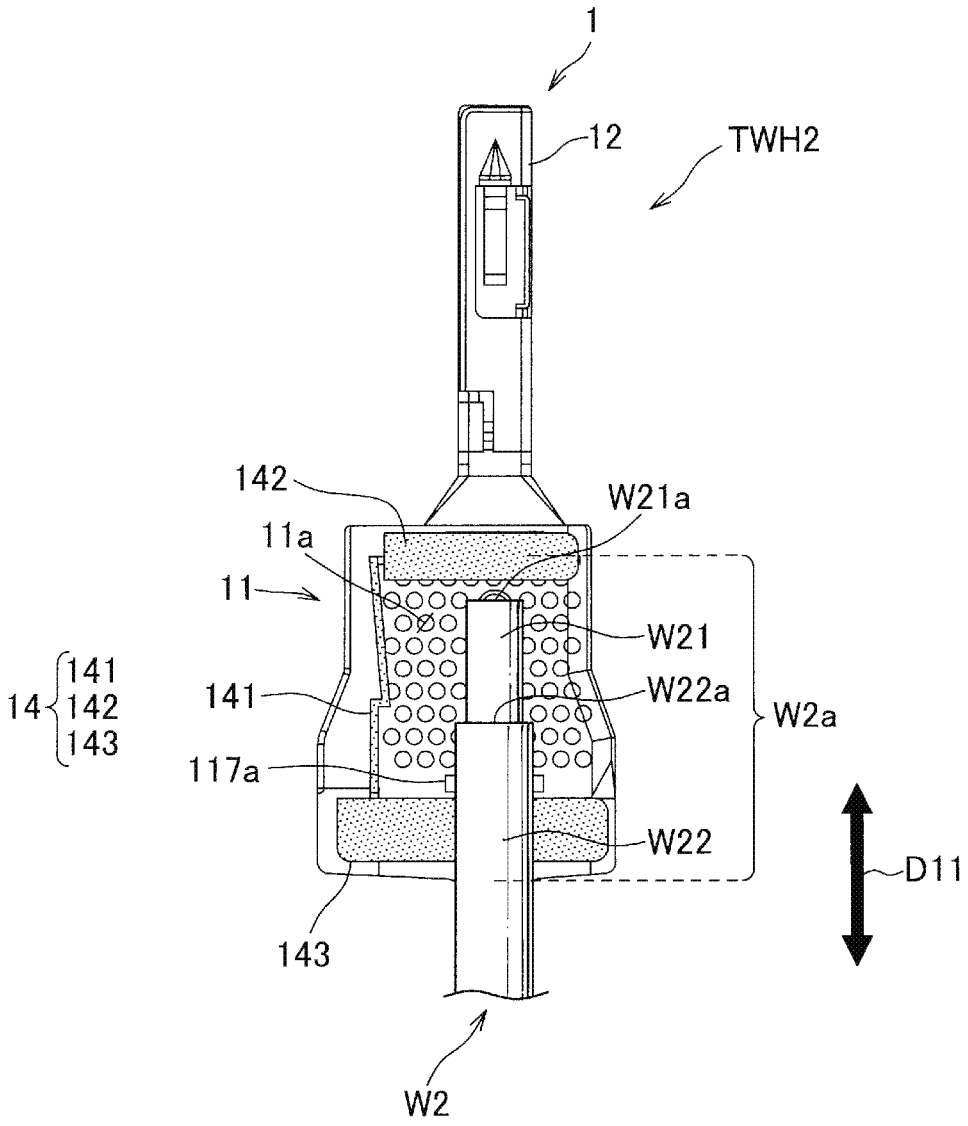
FIG. 12 shows a second modified example with respect to the embodiment shown in FIGS. 1-10.

FIG. 12 shows a second modified example with respect to the embodiment shown in FIGS. 1-10.

In an electric wire with terminal TWH2 according to this second modified example, a state of placement of an end portion W2*a* of the covered electric wire W2 onto the inner surface 11*a* of the barrel portion 11 is different from the above-described embodiment. That is, in the second modified example, the end portion W2*a* of the covered electric wire W2 is placed onto the inner surface 11*a* of the barrel portion 11 such that a tip W21*a* of an aluminum core wire W21 is arranged off from the second seal portion 142 toward a side opposite to the terminal portion 12. In addition, in this second modified example, the end portion W2*a* of the covered electric wire W2 is placed onto the inner surface 11*a* of the barrel portion 11 such that a tip W22*a* of a covered portion W22 is arranged off from the third seal portion 143 toward the terminal portion 12. As a result, in the second modified example, the crimp terminal 1 is crimped to the covered electric wire W2 such that the covered portion W22 contacts the first indent 117*a*.

Compared to this second modified example, the above-described embodiment can provide electrical continuity for longer range on the inner surface 11*a* of the barrel portion 11 in the axial direction D11, thereby providing sufficient electrical conductivity, as described above. In addition, in the above-described embodiment, since the first indent 117*a* is wound around and directly contacting the aluminum core wire W11, the winding diameter can be reduced for the thickness of the cover, thereby successfully suppressing the return of the barrel portion 11, as described above.

On the other hand, in this second modified example also, the second seal portion 142 is formed into a strip-like shape having a width designed to allow a part of the second seal portion 142 to be pushed out from the opening 11*b* of the barrel portion 11 after the crimping, and the seal portion 141 is formed into a width and a shape corresponding to the groove 116, as is the case with the above-described embodiment. Consequently, as with the above-described embodiment, in this second modified example also, difficulty of manufacturing can be reduced while securely providing waterproof property with respect to the contact portion with the aluminum core wire W21.

Figure 13:
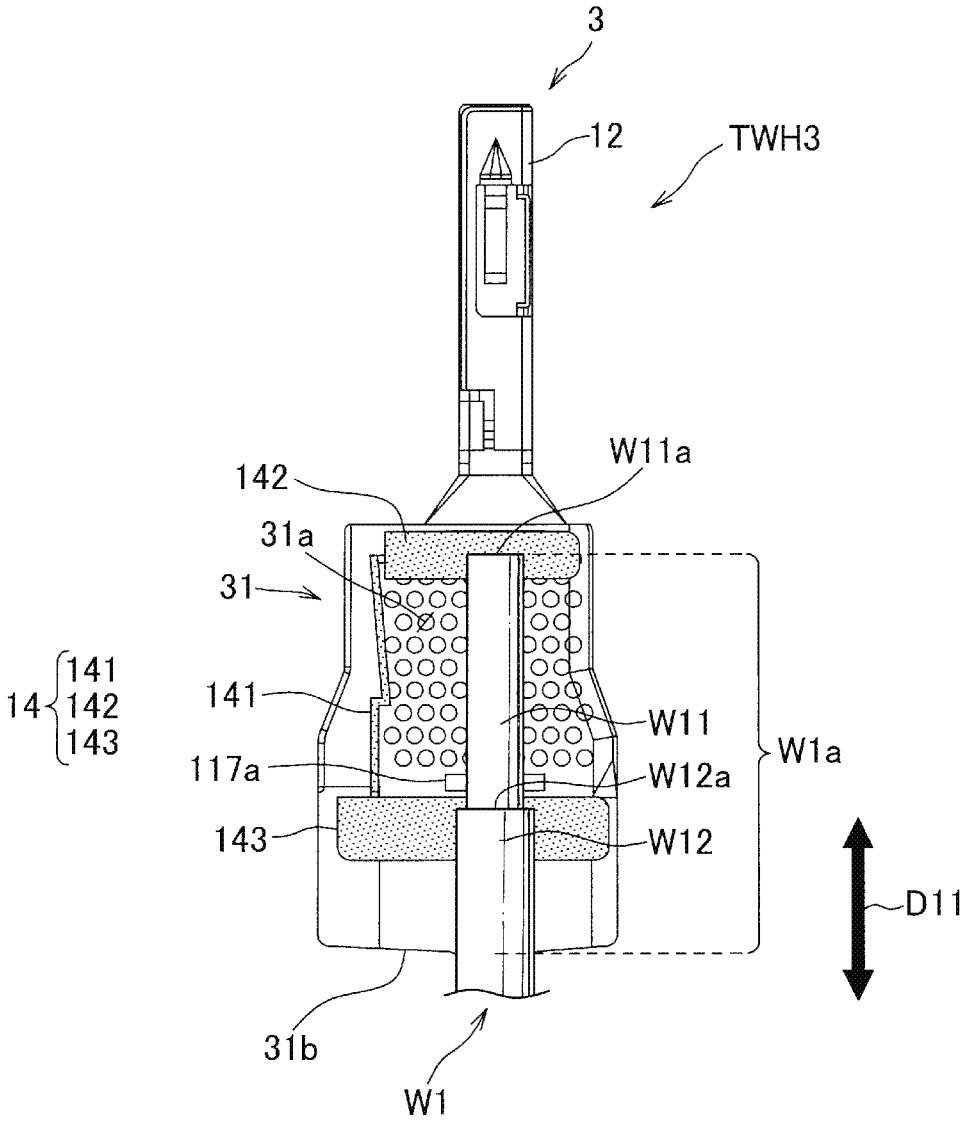
FIG. 13 shows a third modified example with respect to the embodiment shown in FIGS. 1-10.

FIG. 13 shows a third modified example with respect to the embodiment shown in FIGS. 1-10.

In an electric wire with terminal TWH3 according to this third modified example, a crimp terminal 3 includes the third seal portion 143 of the seal member 14 that is arranged distant from an edge 31*b* of a barrel portion 31 that intersects with the covered portion W12. Thus, in a terminal connecting method according to this third modified example, a placing step for placing the end portion W1*a* of the covered portion W12 on an inner surface 31*a* of the barrel portion 31 includes the following steps. That is, the placing step according to the third modified example includes placing the end portion W1*a* such that the covered portion W12 directly contacts the inner surface 31*a* of the barrel portion 31 between the seal member 14 and the edge 31*b* of the barrel portion 31.

On the other hand, as with the above-described embodiment, the tip W11*a* of the aluminum core wire W11 overlaps the second seal portion 142, the tip W12*a* of the covered portion W12 overlaps the third seal portion 143, and the exposed portion of the aluminum core wire W11 contacts with the first indent 117*a*. In addition, the second seal portion 142 is formed into a strip-like shape having a width designed to allow a part of the second seal portion 142 to be pushed out from the opening 11*b* of the barrel portion 11 after the crimping, and the seal portion 141 is formed into a width and a shape corresponding to the groove 116, as is the case with the above-described embodiment.

According to this third modified example, of course, difficulty of manufacturing can be reduced while securely providing waterproof property with respect to the contact portion with the aluminum core wire W11, as with the above-described embodiment. In addition, the electrical conductivity can be sufficiently and securely obtained, and also the return of the barrel portion 31 can be successfully suppressed, as with the above-described embodiment.

Moreover, according to this third modified example, a part between the third seal portion 143 of the seal member 14 and the edge 31*b* of the barrel portion 31 is crimped while directly contacting with the covered portion W12. Consequently, fastening force of the barrel portion 31 with respect to the covered portion W12 that is likely to move and likely to be applied with force in use and such can be improved.

Next, three modified examples of the groove 116 of the barrel portion 11 will be explained below, as fourth through sixth modified examples of the above-described embodiment.

Figure 14:
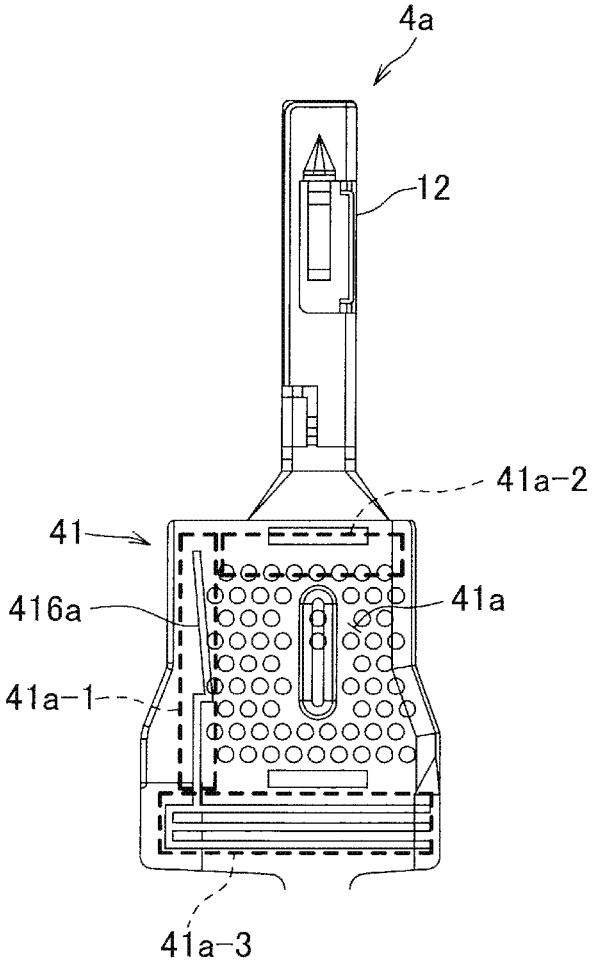
FIG. 14 shows a fourth modified example with respect to the embodiment shown in FIGS. 1-10.

FIG. 14 shows the fourth modified example with respect to the embodiment shown in FIGS. 1-10, FIG. 15 shows the fifth modified example with respect to the embodiment shown in FIGS. 1-10, and FIG. 16 shows the sixth modified example with respect to the embodiment shown in FIGS. 1-10. In these FIGS. 14-16, the crimp terminal is shown with the seal member removed so that a groove according to each modified example can be seen easily.

In a crimp terminal 4*a* according to the fourth modified example shown in FIG. 14, a groove 416*a* of a barrel portion 41 is provided in a first region 41*a*-1 and a third region 41*a*-3 of an inner surface 41*a*, but is not provided in a second region 41*a*-2. A shape of the groove 416*a* in the first region 41*a*-1 and the third region 41*a*-3 is the same as the groove 116 of the above-described embodiment.

Figure 15:
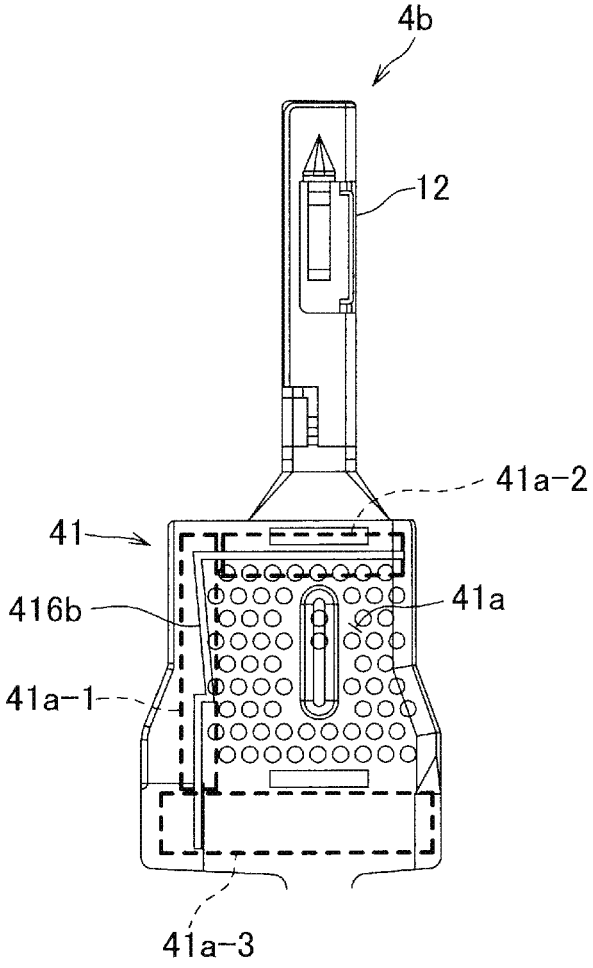
FIG. 15 shows a fifth modified example with respect to the embodiment shown in FIGS. 1-10.

In a crimp terminal 4*b* according to the fifth modified example shown in FIG. 15, a groove 416*b* of the barrel portion 41 is provided in the first region 41*a*-1 and the second region 41*a*-2 of the inner surface 41*a*, but is not provided in the third region 41*a*-3 except for an extending part from the first region 41*a*-1. A shape of the groove 416*b* in the first region 41*a*-1 and the third region 41*a*-3 is the same as the groove 116 of the above-described embodiment.

Figure 16:
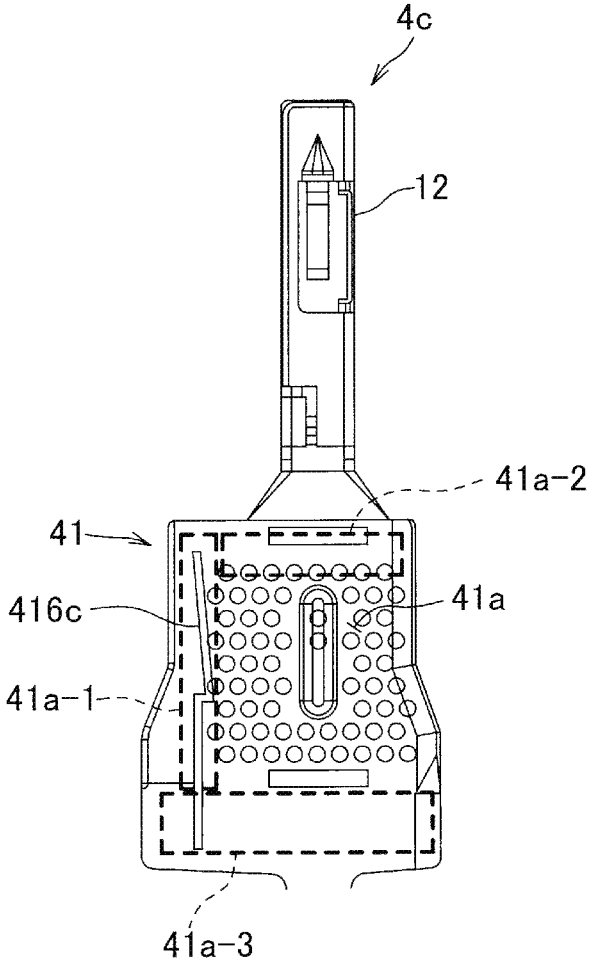
FIG. 16 shows a sixth modified example with respect to the embodiment shown in FIGS. 1-10.

In a crimp terminal 4*c* according to the sixth modified example shown in FIG. 16, a groove 416*c* of the barrel portion 41 is provided in the first region 41*a*-1 of the inner surface 41*a*, but is not provided in the second region 41*a*-2. Furthermore, the groove 416*c* is not provided in the third region 41*a*-3 except for an extending part from the first region 41*a*-1. A shape of the groove 416*c* in the first region 41*a*-1 is the same as the groove 116 of the above-described embodiment.

In the fourth through sixth modified examples also, the seal member 14 is attached, and then is bonded to the end portion W1*a* of the covered electric wire W1, as with the case of the above-described embodiment. Consequently, as with the above-described embodiment, difficulty of manufacturing can be reduced while securely providing waterproof property with respect to the contact portion with the aluminum core wire W11. In addition, the electrical conductivity can be sufficiently and securely obtained, and also the return of the barrel portion 41, 51, 61 can be successfully suppressed, as with the above-described embodiment.

Next, five modified examples of the seal member 14 will be explained below, as seventh through eleventh modified examples of the above-described embodiment.

Figure 17:
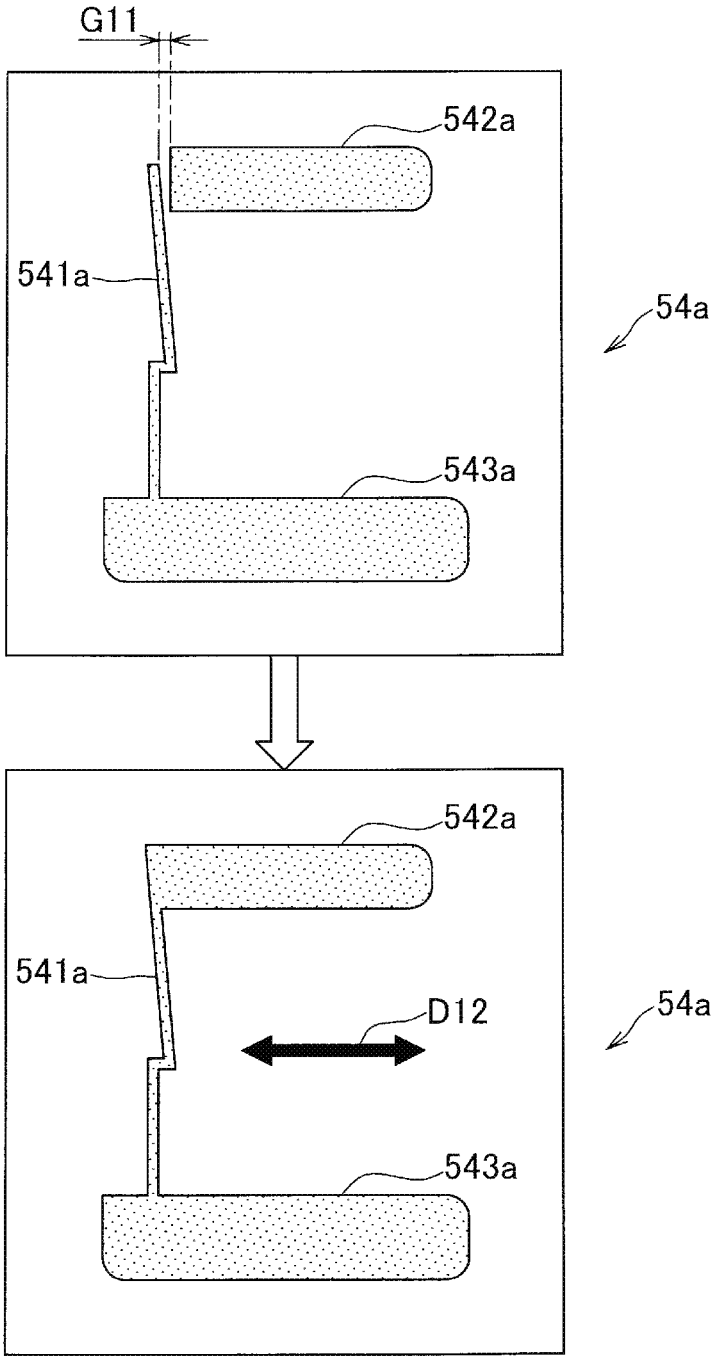
FIG. 17 shows a seventh modified example with respect to the embodiment shown in FIGS. 1-10.

FIG. 17 shows the seventh modified example with respect to the embodiment shown in FIGS. 1-10, FIG. 18 shows the eighth modified example with respect to the embodiment shown in FIGS. 1-10, FIG. 19 shows the ninth modified example with respect to the embodiment shown in FIGS. 1-10. FIG. 20 shows the tenth modified example with respect to the embodiment shown in FIGS. 1-10, and FIG. 21 shows the eleventh modified example with respect to the embodiment shown in FIGS. 1-10.

In a seal member 54*a* according to the seventh modified example shown in FIG. 17, a second seal portion 542*a* is divided from a first seal portion 541*a*, while the third seal portion 543*a* is connected to the first seal portion 541*a*. Shapes of the respective seal portions are substantially the same as the respective seal portions of the seal member 14 of the above-described embodiment. In the seal member 54*a* of the seventh modified example, during the crimping, the second seal portion 542*a* is elongated in the intersecting direction D12 that is coincident with a length direction thereof. Due to this elongation, the second seal portion 542*a* is connected to the first seal portion 541*a*, thereby closing the gap G11 between them.

Figure 18:
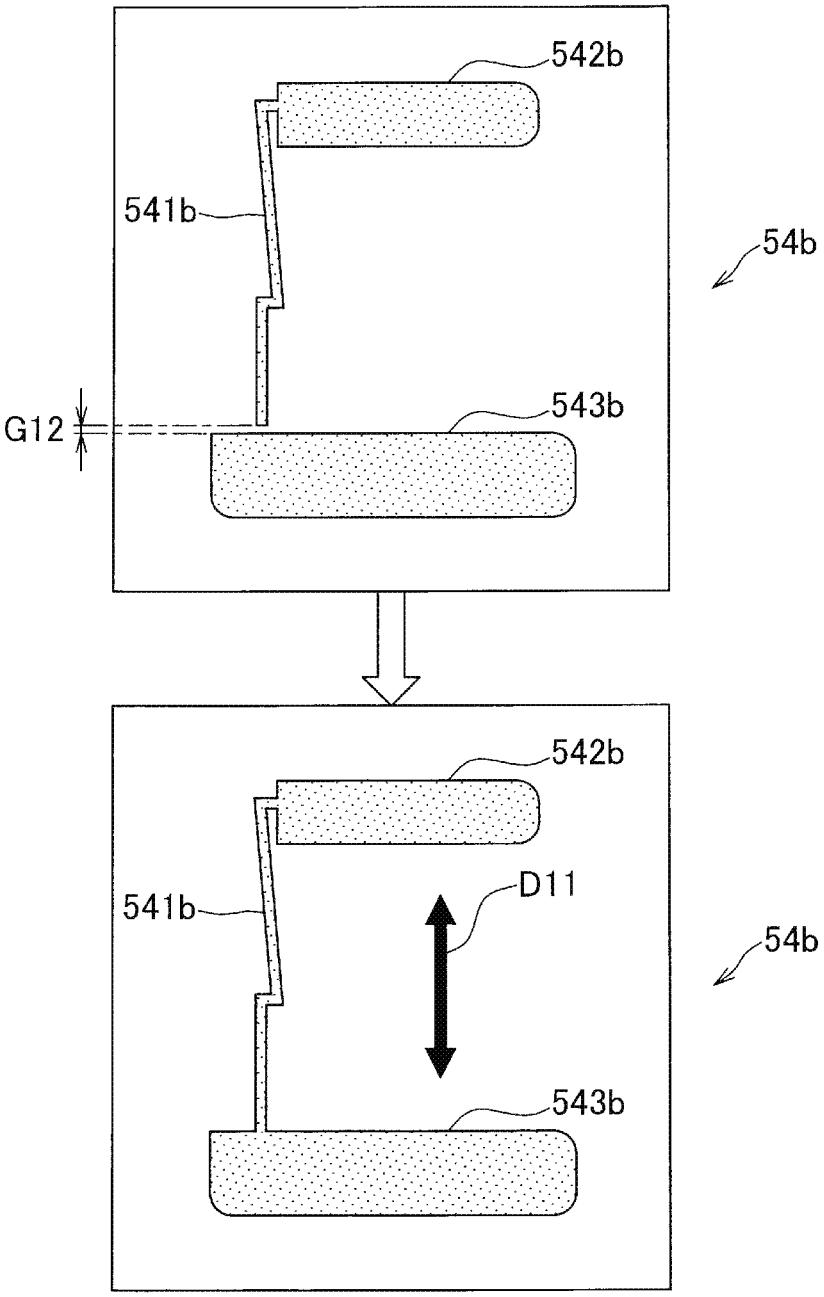
FIG. 18 shows an eighth modified example with respect to the embodiment shown in FIGS. 1-10.

In a seal member 54*b* according to the eighth modified example shown in FIG. 18, a third seal portion 543*b* is divided from a first seal portion 541*b*, while the second seal portion 542*b* is connected to the first seal portion 541*b*. Shapes of the respective seal portions are substantially the same as the respective seal portions of the seal member 14 of the above-described embodiment. In the seal member 54*b* of the eighth modified example, during the crimping, the first seal portion 541*b* is elongated in the axial direction D11 that is coincident with a length direction thereof. Due to this elongation, the first seal portion 541*b* is connected to the third seal portion 543*b*, thereby closing the gap G12 between them.

In a seal member 54*c* according to the ninth modified example shown in FIG. 19, a third seal portion 543*c* has a shape as described below. That is, this third seal portion 543*c* is formed to have a width and a shape corresponding to the groove 116 in the third region 11*a*-3 shown in FIG. 2. Specifically, the third seal portion 543*c* is formed to have substantially the same width and the same shape as the groove 116 so the third seal portion 543*c* can be received inside the groove. In addition, both of a second seal portion 542*c* and the third seal portion 543*c* are divided from a first seal portion 541*c*. Shapes of the first seal portion 541*c* and the second seal portion 542*c* are substantially the same as the seal member 14 of the above-described embodiment. In the seal member 54*c* of the ninth modified example, during the crimping, the second seal portion 542*c* is elongated in the intersecting direction D12 that is coincident with a length direction thereof. Due to this elongation, the second seal portion 542*c* is connected to the first seal portion 541*c*, thereby closing the gap G11 between them. Furthermore, the first seal portion 541*c* is elongated in the axial direction D11 that is coincident with a length direction thereof. Due to this elongation, the first seal portion 541*c* is connected to the third seal portion 543*c*, thereby closing the gap G12 between them.

Figure 19:
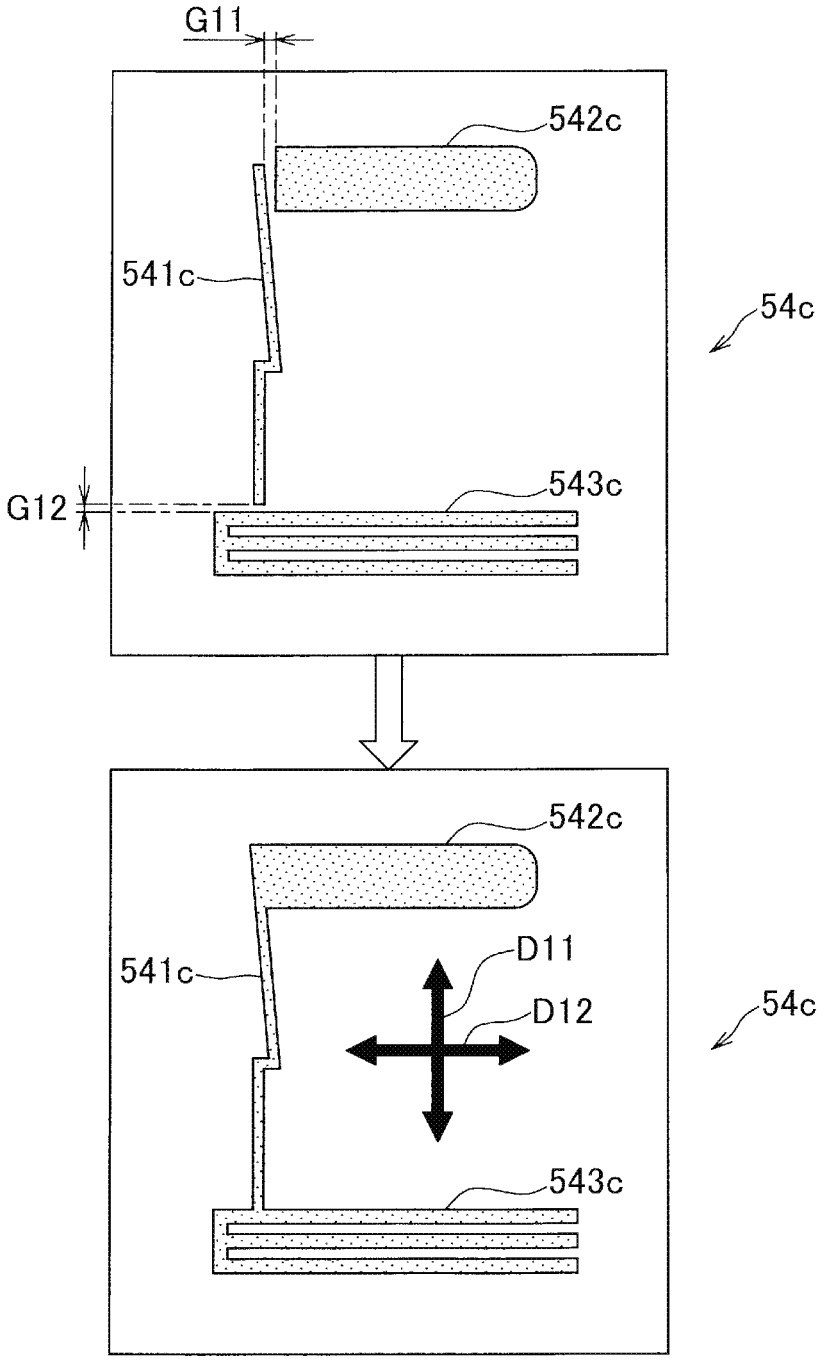
FIG. 19 shows a ninth modified example with respect to the embodiment shown in FIGS. 1-10.
Figure 20:
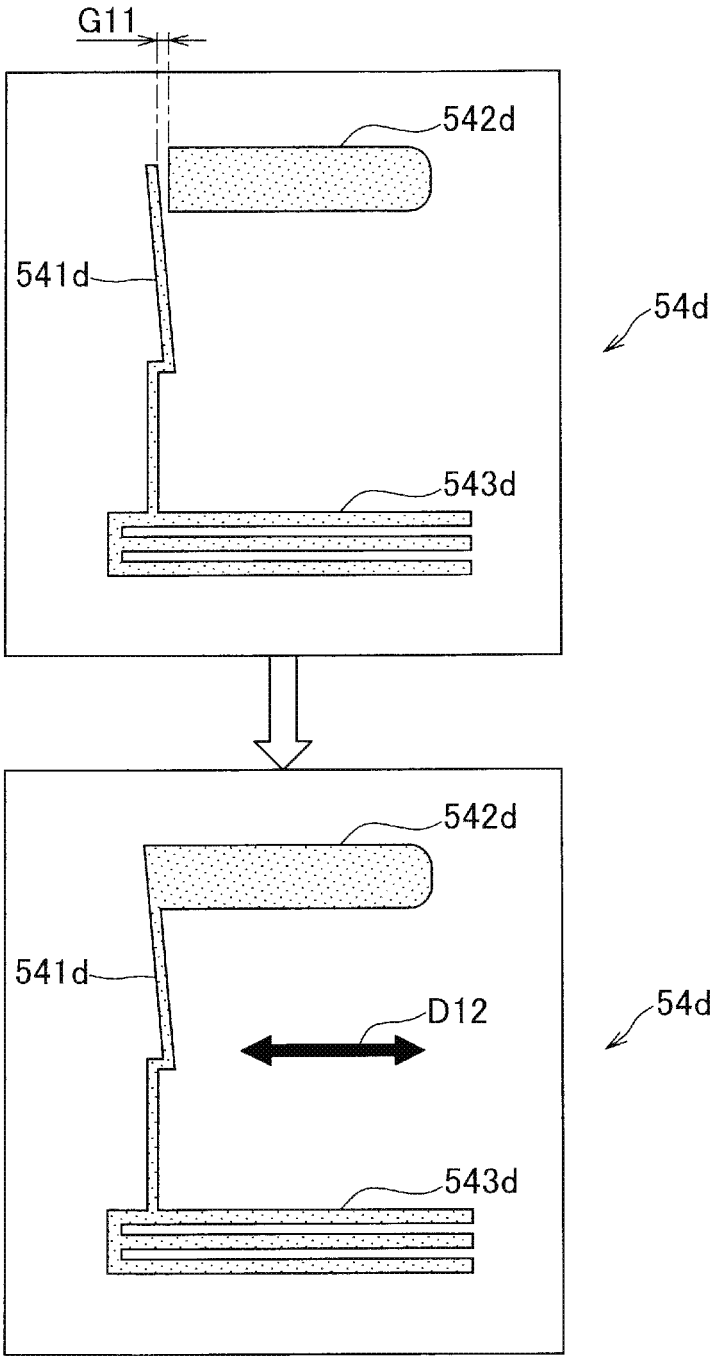
FIG. 20 shows a tenth modified example with respect to the embodiment shown in FIGS. 1-10.

A seal member 54*d* according to the tenth modified example shown in FIG. 20 is a further modified version of the seal member 54*c* of the ninth modified example shown in FIG. 19. That is, in the seal member 54*d* according to the tenth modified example, a second seal portion 542*d* is divided from a first seal portion 541*d*, but the third seal portion 543*d* is connected to the first seal portion 541*d*. Meanwhile, shapes of the respective seal portions are substantially the same as the respective seal portions of the seal member 54*c* of the ninth modified example. In the seal member 54*d* of the tenth modified example, during the crimping, the second seal portion 542*d* is elongated in the intersecting direction D12 that is coincident with a length direction thereof. Due to this elongation, the second seal portion 542*d* is connected to the first seal portion 541*d*, thereby closing the gap G11 between them.

Figure 21:
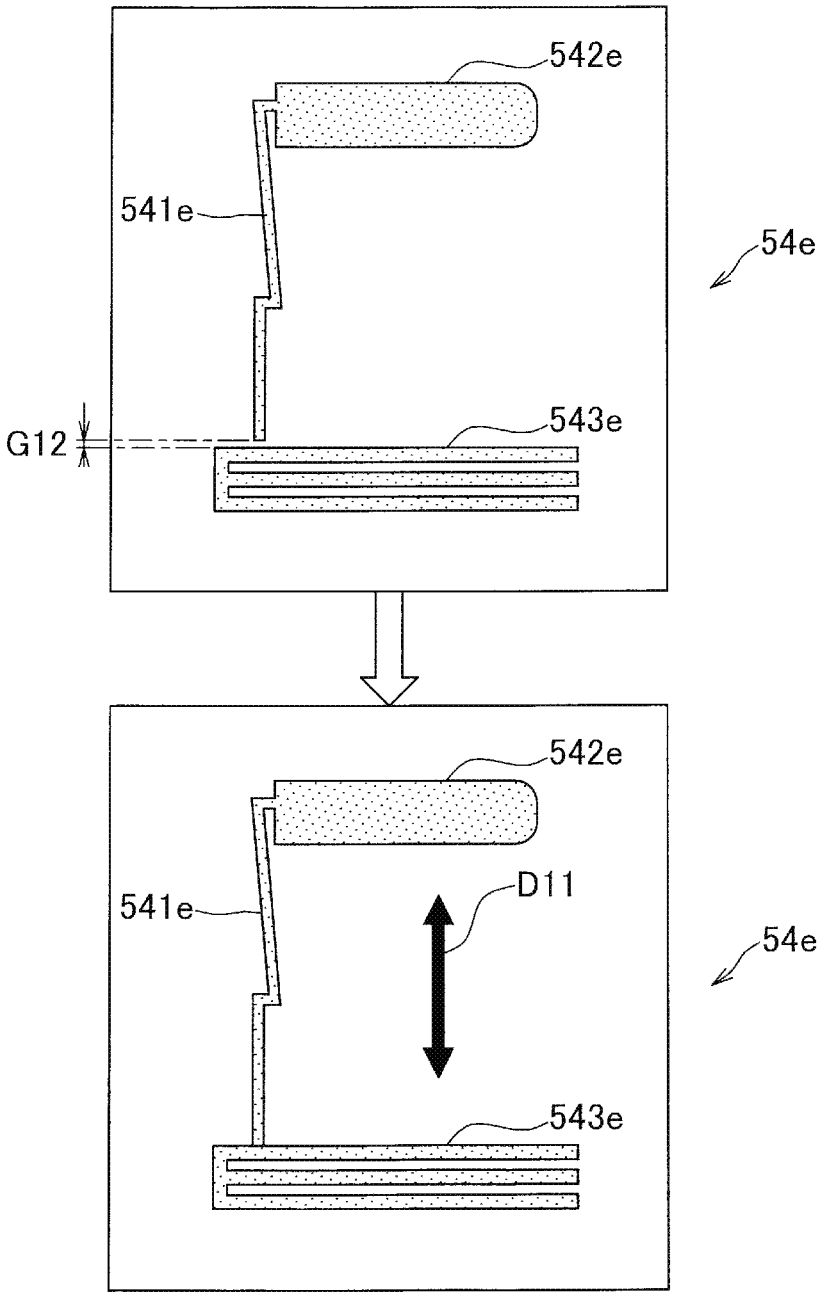
FIG. 21 shows an eleventh modified example with respect to the embodiment shown in FIGS. 1-10.

A seal member 54*e* according to the eleventh modified example shown in FIG. 21 is also a further modified version of the seal member 54*c* of the ninth modified example shown in FIG. 19. That is, in the seal member 54*e* according to the eleventh modified example, a third seal portion 543*e* is divided from a first seal portion 541*e*, but a second seal portion 542*e* is connected to the first seal portion 541*e*. Meanwhile, shapes of the respective seal portions are substantially the same as the respective seal portions of the seal member 54*c* of the ninth modified example. In the seal member 54*e* of the eleventh modified example, during the crimping, the first seal portion 541*e* is elongated in the axial direction D11 that is coincident with a length direction thereof. Due to this elongation, the first seal portion 541*e* is connected to the third seal portion 543*e*, thereby closing the gap G12 between them.

In the seventh through eleventh modified examples also, the seal member 54*a*, 54*b*, 54*c*, 54*d*, 54*e* is attached to the barrel portion 11 and bonded to the end portion W1*a* of the covered electric wire W1, as with the case of the above-described embodiment. Consequently, as with the above-described embodiment, difficulty of manufacturing can be reduced while securely providing waterproof property with respect to the contact portion with the aluminum core wire W11. In addition, the electrical conductivity can be sufficiently and securely obtained, and also the return of the barrel portion 11 can be successfully suppressed, as with the above-described embodiment.

Moreover, the ninth through eleventh modified examples in which the third seal portion 543*c*, 543*d*, 543*e* is formed into a width and a shape corresponding to the groove 116 in the third region 11*a*-3 have the following additional advantages. According to the ninth through eleventh modified examples, amount of the third seal portion 543*c*, 543*d*, 543*e* can also be minimized. Consequently, the sealing of the respective portions of the barrel portion 11 is performed while further suppressing the hindrance to the crimping by the seal member 54*c*, 54*d*, 54*e*, thereby further reducing difficulty of manufacturing.

Next, three modified examples of the recess 114 that is circular in a plan view and provided on the inner surface 11*a* of the barrel portion 11 will be explained below, as twelfth through fourteenth modified examples of the above-described embodiment.

Figure 22:
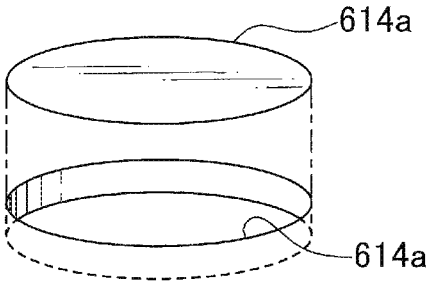
FIG. 22 shows a twelfth modification with respect to the embodiment shown in FIGS. 1-10.
Figure 23:
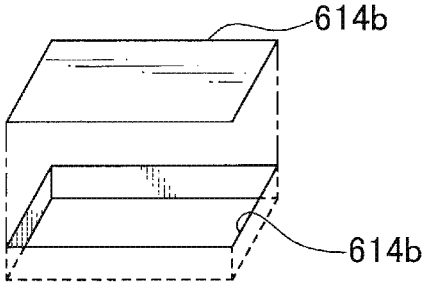
FIG. 23 shows a thirteenth modified example with respect to the embodiment shown in FIGS. 1-10.
Figure 24:
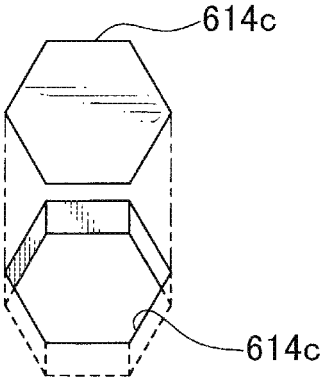
FIG. 24 shows a fourteenth modified example with respect to the embodiment shown in FIGS. 1-10.

FIG. 22 shows the twelfth modification with respect to the embodiment shown in FIGS. 1-10, FIG. 23 shows the thirteenth modified example with respect to the embodiment shown in FIGS. 1-10, and FIG. 24 shows the fourteenth modified example with respect to the embodiment shown in FIGS. 1-10.

A recess 614*a* according to the twelfth modified example shown in FIG. 22 is formed into an oval shape in a plan view. A recess 614*b* according to the thirteenth modified example shown in FIG. 20 is formed into a parallelogram in a plan view. A recess 614*c* according to the fourteenth modified example shown in FIG. 21 is formed into a hexagonal shape in a plan view.

Other modified examples of the recess 114 of the crimp terminal 1 of the above-described embodiment may include, for example, those formed into a triangular shape or other polygonal shapes in a plan view. Any of these modified examples is highly resistant to a force to expand in an in-plane direction of the inner surface 11*a*, compared to the linear groove extending in the intersecting direction D12 that is conventionally employed as a serration, for example.

Next, four modified examples of the seal member 14 will be explained below, as fifteenth through eighteenth modified examples of the above-described embodiment.

Figure 25:
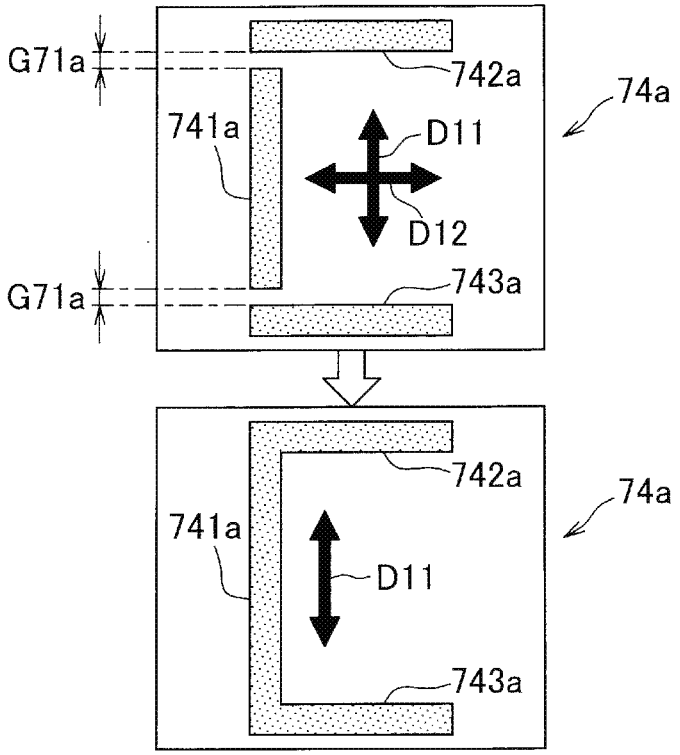
FIG. 25 shows a fifteenth modified example with respect to the embodiment shown in FIGS. 1-10.

FIG. 25 shows the fifteenth modified example with respect to the embodiment shown in FIGS. 1-10, and FIG. 26 shows the sixteenth modified example with respect to the embodiment shown in FIGS. 1-10. FIG. 27 shows the seventeenth modified example with respect to the embodiment shown in FIGS. 1-10, and FIG. 28 shows then eighteenth modified example with respect to the embodiment shown in FIGS. 1-10.

In a seal member 74*a* according to the fifteenth modified example shown in FIG. 25, a first seal portion 741*a* is a portion extending in a strip-like shape in the axial direction D11 in the first region 11*a*-1. A second seal portion 742*a* is a portion extending in a strip-like shape in the intersecting direction D12 in the second region 11*a*-2. A third seal portion 743*a* is a portion extending in a strip-like shape in the intersecting direction D12 in the third region 11*a*-3. Both of the second seal portion 742*a* and the third seal portion 743*a* are divided from the first seal portion 741*a*. Specifically, each of the second seal portion 742*a* and the third seal portion 743*a* is divided from the first seal portion 741*a* with a gap G71*a* traversing the path 11*a*-4 shown in FIG. 2 in the intersecting direction D12. The first seal portion 741*a*, the second seal portion 742*a* and the third seal portion 743*a* are attached to the barrel portion 11 so as to overlap with the groove 116. In the seal member 74*a* according to the fifteenth modified example, during the crimping, the first seal portion 741*a* is elongated in the axial direction D11 that is coincident with a length direction thereof. Due to this elongation, the first seal portion 741*a* is connected to both of the second seal portion 742*a* and the third seal portion 743*a*, thereby closing the gap G71*a* between them.

Figure 26:
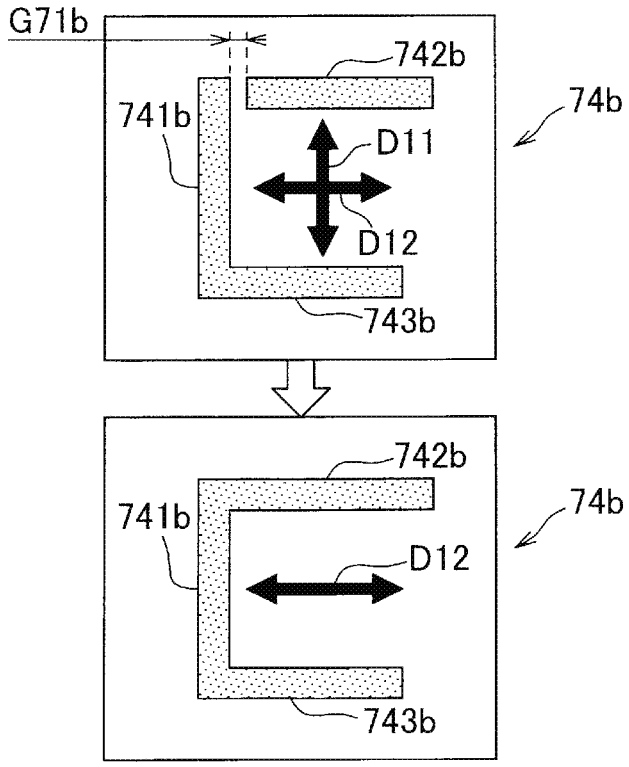
FIG. 26 shows a sixteenth modified example with respect to the embodiment shown in FIGS. 1-10.
Figure 27:
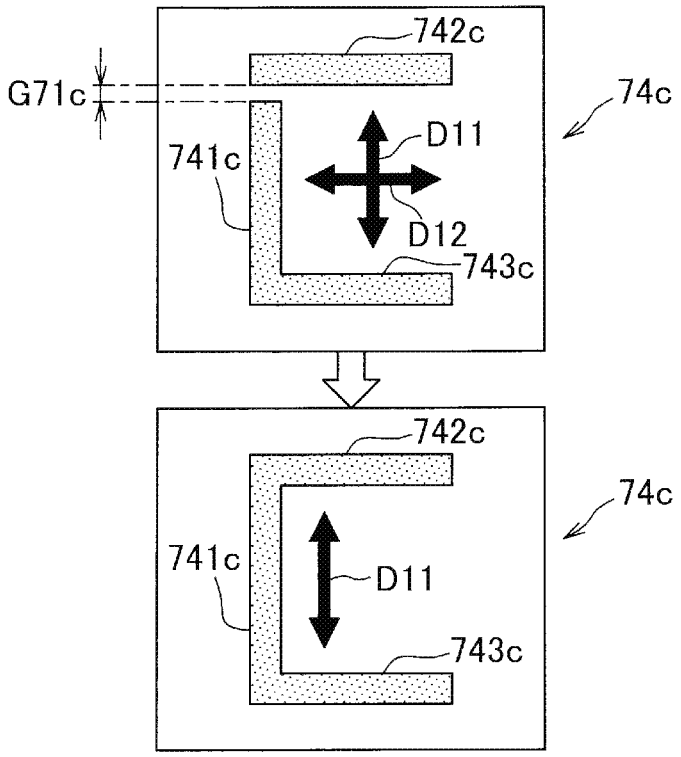
FIG. 27 shows a seventeenth modified example with respect to the embodiment shown in FIGS. 1-10.

A seal member 74*b* according to the sixteenth modified example shown in FIG. 26 is a further modified version of the seal member 74*a* of the fifteenth modified example shown in FIG. 25. That is, in the seal member 74*b* according to the sixteenth modified example, a second seal portion 742*b* is divided from a first seal portion 741*b*, but a third seal portion 743*b* is connected to the first seal portion 741*b*. In addition, in this sixteenth modified example, the second seal portion 742*b* is divided from the first seal portion 741*b* with a gap G71*b* traversing the above-described path 11*a*-4 in the axial direction D11. In the seal member 74*b* according to the sixteenth modified example, during the crimping, the second seal portion 742*b* is elongated in the intersecting direction D12 that is coincident with a length direction thereof. Due to this elongation, the second seal portion 742*b* is connected to the first seal portion 741*b*, thereby closing the gap G71*b* between them.

A seal member 74*c* according to the seventeenth modified example shown in FIG. 27 is also a further modified version of the seal member 74*a* of the fifteenth modified example shown in FIG. 25. That is, in the seal member 74*c* according to the seventeenth modified example, a second seal portion 742*c* is divided from a first seal portion 741*c*, but a third seal portion 743*c* is connected to the first seal portion 741*c*. In addition, in this seventeenth modified example, the second seal portion 742*c* is divided from the first seal portion 741*c* with a gap G71*c* traversing the above-described path 11*a*-4 in the intersecting direction D12. In the seal member 74*c* according to the seventeenth modified example, during the crimping, the first seal portion 741*c* is elongated in the axial direction D11. Due to this elongation, the first seal portion 741*c* is connected to the second seal portion 742*c*, thereby closing the gap G71*c* between them.

Figure 28:
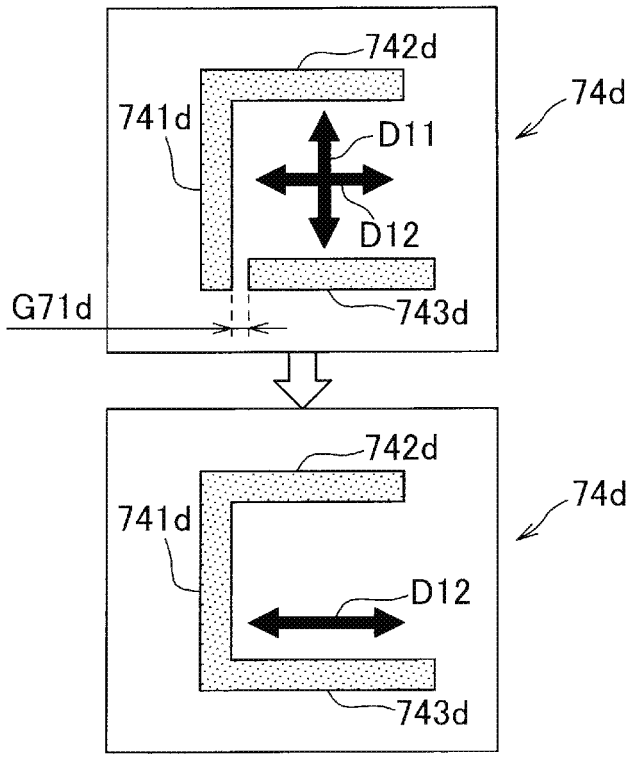
FIG. 28 shows an eighteenth modified example with respect to the embodiment shown in FIGS. 1-10.
Figure 29:
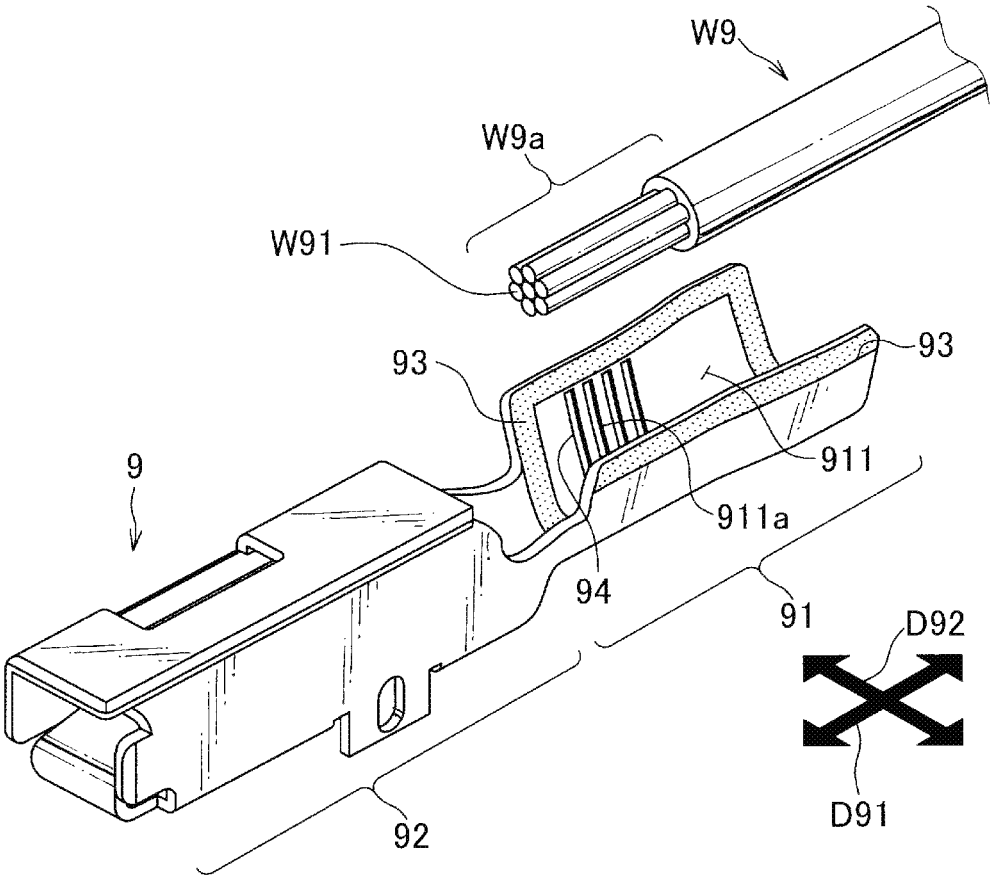
FIG. 29 shows an example of a conventional crimp terminal in which a contact portion between a barrel portion and an aluminum core wire is surrounded by a seal member.

A seal member 74*d* according to the eighteenth modified example shown in FIG. 28 is also a further modified version of the seal member 74*a* of the fifteenth modified example shown in FIG. 25. That is, in the seal member 74*d* according to the eighteenth modified example, a third seal portion 743*d* is divided from a first seal portion 741*d*, but a second seal portion 742*d* is connected to the first seal portion 741*d*. In addition, in this eighteenth modified example, the third seal portion 743*d* is divided from the first seal portion 741*d* with a gap G71*d* traversing the above-described path 11*a*-4 in the axial direction D11. In the seal member 74*d* according to the eighteenth modified example, during the crimping, the third seal portion 743*d* is elongated in the intersecting direction D12. Due to this elongation, the third seal portion 743*d* is connected to the first seal portion 741*d*, thereby closing the gap G71*d* between them.

Compared to the fifteenth through eighteenth modified examples, in the above-described embodiment, the first seal portion 141 is formed into the width and the shape corresponding to the groove 116, and thus the amount of the first seal portion 141 is reduced, so difficulty of manufacturing can be reduced more, as described above.

On the other hand, these fifteenth through eighteenth modified examples, when they are crimped to the covered electric wire W1 as shown for example in FIG. 5, can also provide sufficient electrical conductivity and can successfully suppress the return of the barrel portion 31, as with the above-described embodiment.

The embodiment described herein only illustrates a representative embodiment of the present invention, and the present invention is not limited to this embodiment. That is, various modifications may be made without departing from the scope of the present invention. One with such modifications is within the scope of the present invention as long as configuration of the present invention is included.

For example, the above-described embodiment and various modified examples exemplary show the barrel portion provided with the protrusion formed by applying pressing from the outer surface side. However, the barrel portion is not limited to this, and this protrusion may be omitted. However, as described above, by providing the protrusion, the strands of the aluminum core wire can be separated and spread thereby the number of strands contacting the barrel portion can be increased.

Furthermore, the above-described embodiment and various modified examples exemplary show the crimp terminal provided with the terminal portion 12 as a quadrangular tube-like female terminal, as one example of the terminal portion. However, the terminal portion is not limited to this, and may have other shapes and may involve other connection forms.

LIST OF REFERENCE SIGNS

1, 2, 3, 4*a*, 4*b*, 4*c* crimp terminal
11, 21, 31, 41 barrel portion
11*a*, 31*a*, 41*a* inner surface
11*a*-1, 41*a*-1 first region
11*a*-2, 41*a*-2 second region
11*a*-3, 41*a*-3 third region
11*a*-4, 41*a*-4 path
12 terminal portion
14, 54*a*, 54*b*, 54*c*, 54*d*, 54*e*, 74*a*, 74*b*, 74*c*, 74*d* seal member
111 bottom plate
112 inner barrel piece
113 outer barrel piece
114, 614*a*, 614*b*, 614*c* recess
115 protrusion
116, 416*a*, 416*b*, 416*c* groove
117*a* first indent (projection)
117*b* second indent (second projection)
141, 541*a*, 541*b*, 541*c*, 541*d*, 541*e*, 741*a*, 741*b*, 741*c*, 741*c* first seal portion
142, 542*a*, 542*b*, 542*c*, 542*d*, 542*e*, 742*a*, 742*b*, 742*c*, 742*c* second seal portion
143, 543*a*, 543*b*, 543*c*, 543*d*, 543*e*, 743*a*, 743*b*, 743*c*, 743*c* third seal portion
D1 axial direction
D12 intersecting direction
G11, G12, G71*a*, G71*b*, G71*c*, G71*d* gap
W1 covered electric wire
W1*a* end portion
W11 aluminum core wire
W11*a* tip
W12 covered portion
W12*a* tip
TW1, TWH1, TWH2, TWH3 electric wire with terminal

The invention claimed is:

1. A crimp terminal comprising:

a barrel portion configured to be wound around and crimped to an end portion of a covered electric wire having an aluminum core wire at which the aluminum core wire is exposed; and a terminal portion configured to be connected to a connection object, wherein the barrel portion and the terminal portion are arranged in a predetermined axial direction, wherein the barrel portion includes:

a bottom plate which extends in the axial direction and on which the end portion of the covered electric wire is to be placed; and an inner barrel piece and an outer barrel piece which extend from the bottom plate on both sides in an intersecting direction intersecting with the axial direction in a plan view with respect to the bottom plate, wherein the barrel portion is configured to be wound around the end portion, during crimping, with the inner barrel piece arranged inside, wherein an inner surface of the barrel portion is provided with a plurality of recesses arranged dispersedly, and a groove, wherein, of a first region traversing the outer barrel piece in the axial direction, a second region traversing the inner surface in the intersecting direction at a location close to the terminal portion and a third region traversing the inner surface in the intersecting direction so as to intersect with a covered portion of the end portion, the groove extends at least in the first region, wherein the crimp terminal includes a seal member formed from adhesive gel and configured to be attached over the first region, the second region and the third region to seal, after the crimping, a space between the inner barrel piece and the outer barrel piece, an opening of the barrel portion formed cylindrical located on a side of the terminal portion, and a space between the covered portion and the barrel portion, wherein a portion of the seal member to be attached to the second region is formed into a strip-like shape having a width that allows a part of said portion to be pushed out from the opening after the crimping, and wherein a portion of the seal member to be attached to the first region is formed into a shape corresponding to the groove and having a narrower width, in the intersecting direction, than a width, in the axial direction, of said portion of the seal member to be attached to the second region.

2. The crimp terminal according to claim 1, wherein the groove is also provided in the third region so as to extend in the intersecting direction.

3. The crimp terminal according to claim 2, wherein a portion of the seal member to be attached to the third region is also formed into a shape corresponding to the groove and having a narrower width than said portion of the seal member to be attached to the second region.

4. The crimp terminal according to claim 1, wherein the narrower width of the portion of the seal member to be attached to the first region is less than half of the width of said portion of the seal member to be attached to the second region.

* * * * *